US006783179B2

(12) United States Patent
Komura et al.

(10) Patent No.: US 6,783,179 B2
(45) Date of Patent: Aug. 31, 2004

(54) ELEVATION CHAIR

(75) Inventors: Seiichi Komura, Osaka (JP); Takashi Kaneda, Yao (JP); Katuhiko Yamashita, Yao (JP); Kazuya Adachi, Yao (JP); Isamu Mizuseki, Yao (JP)

(73) Assignee: Komura Corporation, Yao (JP)

( * ) Notice: Subject to any disclaimer, the term of this patent is extended or adjusted under 35 U.S.C. 154(b) by 0 days.

(21) Appl. No.: 10/180,343

(22) Filed: Jun. 27, 2002

(65) Prior Publication Data

US 2003/0011228 A1 Jan. 16, 2003

(30) Foreign Application Priority Data

Jul. 11, 2001 (JP) ..... 2001-210213

(51) Int. Cl.[7] ..... A47C 1/02

(52) U.S. Cl. ..... 297/344.12; 297/344.17; 297/330; 297/DIG. 10; 297/331

(58) Field of Search ..... 297/344.17, 335, 297/337, 330, DIG. 10, 344.12, 331; 248/429, 430; 296/65.1

(56) References Cited

U.S. PATENT DOCUMENTS 4,249,774 A * 2/1981 Andreasson ..... 297/311
4,527,829 A * 7/1985 Fanslau et al. ..... 297/17
4,552,404 A * 11/1985 Congleton ..... 297/330
5,108,202 A * 4/1992 Smith ..... 297/330
5,265,689 A * 11/1993 Kauffmann ..... 180/65.5
5,346,280 A * 9/1994 Deumite ..... 297/330
5,984,411 A * 11/1999 Galumbeck ..... 297/344.15
6,142,568 A * 11/2000 Abelbeck et al. ..... 297/344.17
6,588,792 B1 * 7/2003 Koerlin et al. ..... 280/650
2002/0190560 A1 * 12/2002 Kohl et al. ..... 297/344.12

* cited by examiner

*Primary Examiner*—Lanna Mai
*Assistant Examiner*—Erika Garrett
(74) *Attorney, Agent, or Firm*—Armstrong, Kratz, Quintos, Hanson & Brooks, LLP

(57) ABSTRACT

An elevation chair having a seat which is elevated by a driving mechanism, provided with a seat frame and a seat main body attached to the frame as to incline forward, the seat main body has an oscillation mechanism to automatically incline the seat main body forward at a predetermined height, and an angle detecting means to stop the driving mechanism when the seat main body reaches a predetermined inclination angle. And, the elevation chair has an automatic braking mechanism which releases wheels when a footrest attached to a position above a front wheel is laid to be horizontal, and brakes the wheel when the footrest is standing.

4 Claims, 18 Drawing Sheets

(b-b)

(c-c)

ELEVATION CHAIR

BACKGROUND OF THE INVENTION

1. Field of the Invention

This invention relates to an elevation chair.

2. Description of the Related Art

Conventionally, an elderly person sitting in a chair whose knees and legs are weak, and a physically-handicapped person having knees and legs disabled, hold an armrest or a hand rail to stand up from the chair. And, when an auxiliary device to incline the seat of the chair is provided, the inclination angle can not be certainly and easily set and adjusted. And, in a case of a running chair, the chair can not be certainly and easily fixed without failure when the person get on and off the chair.

It is difficult for the elderly person and the physically-handicapped person to stand up from the chair they are sitting by themselves safely and smoothly, great labor is required to stand up, and physical stress is high. And, even in the case of the seat provided with the inclination auxiliary device, setting and adjustment of the inclination of the seat is complicated and difficult to be conducted by a user, and the user may be injured by malfunction. And, in the case of the running chair with wheels, the chair may move backward and the person may fall on the ground when the person gets on and off the chair.

It is therefore an object of the present invention to provide a safe and secure elevation chair with which standing movement of the elderly person whose knees and legs are weak or the physically-handicapped person having knees and legs disabled, is smoothly supported and the stress in standing is alleviated.

BRIEF DESCRIPTION OF THE DRAWINGS

The present invention will be described with reference to the accompanying drawings in which.

DESCRIPTION OF THE PREFERRED EMBODIMENTS

The present invention will be described in detail with reference to the accompanying drawings.

Figure 1:
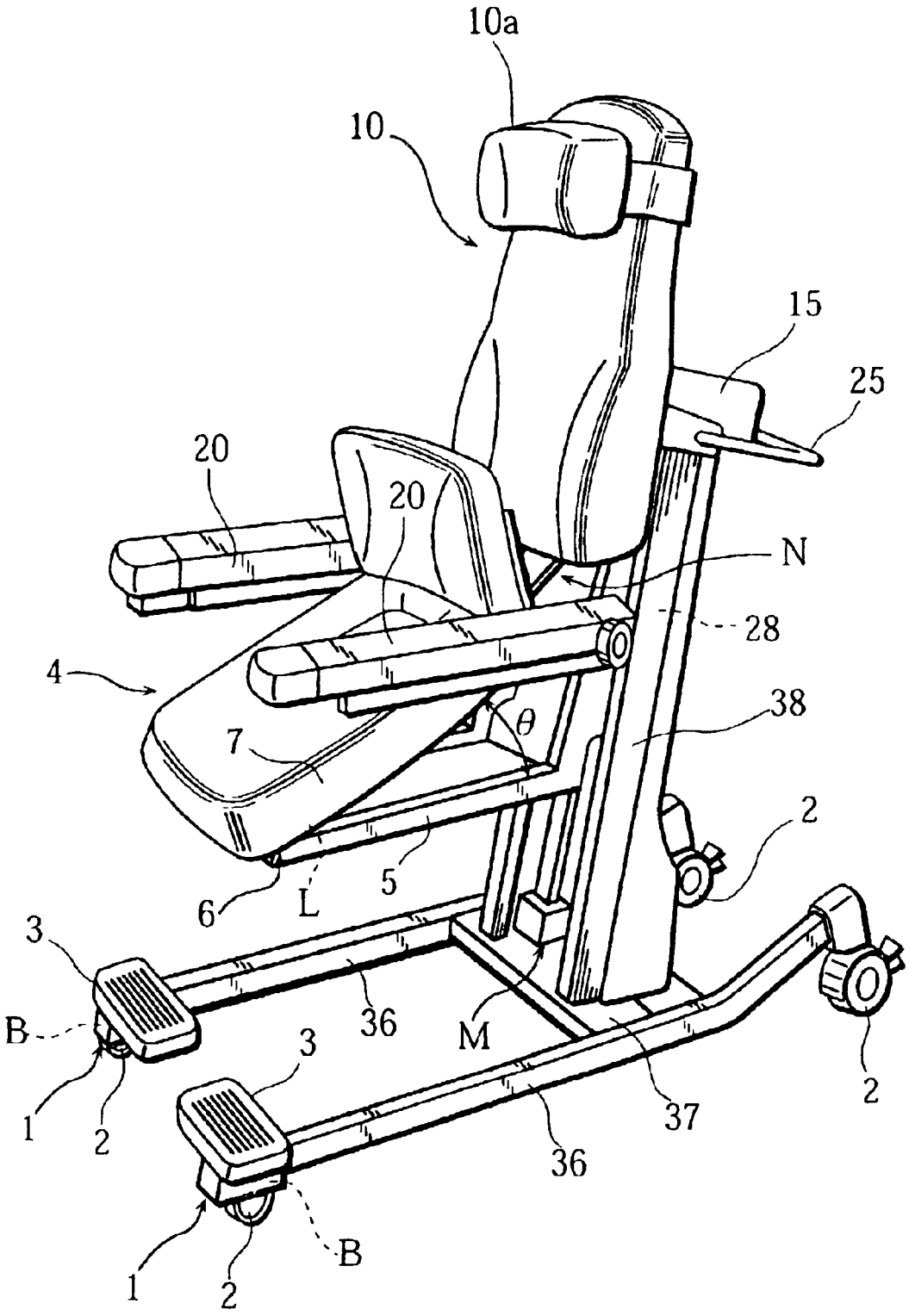
FIG. 1 is a perspective view showing an embodiment of an elevation chair of the present invention.

FIG. 1 shows an embodiment of an elevation chair (a chair with a seat which is lifted up and down) of the present invention. This elevation chair, running on the floor, etc., has a seat 4 which is inclined and elevated (lifted). A lower partof the elevation chair has a pair of bar-shaped leg portions 36, a wheel 2 is attached to both (front and rear) end portions of each of the leg portions 36, and the leg portions 36 are connected with a base member 37. A post 38 is fixed to the base member 37 as to incline backward, and a driving mechanism M, to elevate (ascend and descend) the seat 4 and a back portion 10, is detachably attached to the post 38.

A battery 15 is placed on the post 38 to elevate and incline the seat 4 of the elevation chair independently with electricity. And, a handle 25 for movement is disposed on an upper rear side of the post 38 as the elevation chair can easily run (move).

The seat 4 is provided with a seat frame 5 and a seat main body 7 attached to a forth end portion 6 of the seat frame 5 as to incline forward, and, keeping a horizontal state, elevated (lifted up and down) by the driving mechanism M. And the seat main body 7 is inclined forward by an oscillation mechanism N.

Figure 2:
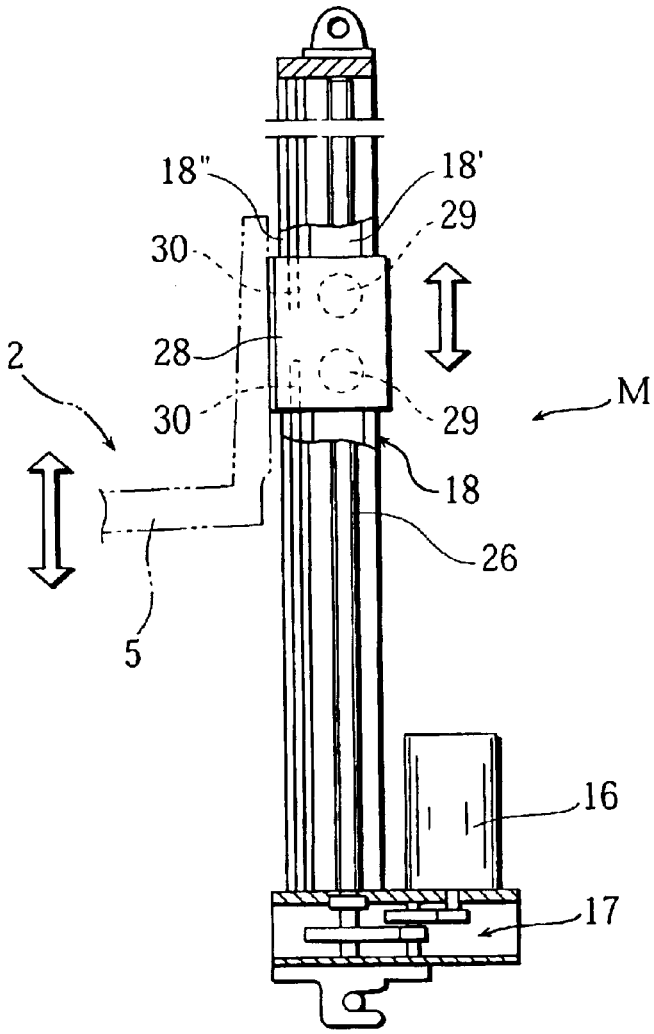
FIG. 2 is a side view of a driving mechanism.
Figure 3:
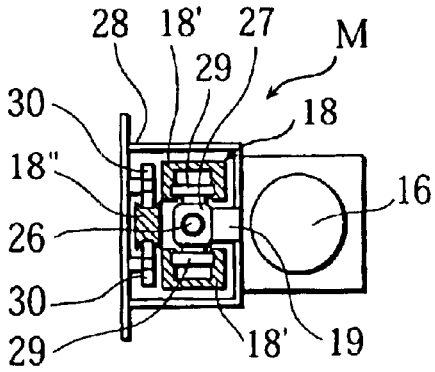
FIG. 3 is a top view of a driving mechanism.

The driving mechanism M to elevate (lift) the seat 4 is, as shown in FIG. 2, provided with a motor 16, a reducer portion 17, a guide rail portion 18, a rotating male screw portion 26, a sliding female screw portion 27, and a sliding member 28 which are united into one unit. And, FIG. 3 is a cross-sectional top view of the driving mechanism M in which rotation (torque) of the motor 16 is transmitted to the rotating male screw portion 26 through the reducer portion 17 to revolve.

And, the sliding female screw portion 27 screwed to the rotating male screw portion 26 has a pair of first rollers 29 which fit to guide rails 18' parallel to the rotating male screw portion 26, and moved (screwed) up and down by the rotation of the rotating male screw portion 26. That is to say, the sliding female screw portion 27 elevates (screws) the rotating male screw portion 26 up and down by restriction of the rotating male screw portion 26 by the guide rails 18'.

The sliding female screw portion 27 is connected to the sliding member 28 through a connencting shaft 19 (refer to FIG. 3), and the sliding member 28 is connected to the seat frame 5 of the seat 4 (refer to FIG. 2). Therefore, the seat 4

(the seat frame 5) is elevated by elevation of the sliding female screw portion 27. And, the seat frame 5 is set to be guided by inner faces of the post 38 shown in FIG. 1.

To switch ascent to descent of the seat 4, the rotating direction of the motor 16 is switched by a controller not shown in Figures mounted on the elevation chair. And, threads of the rotating male screw portion 26 and the sliding female screw portion 27 are set to be self-locked and prevented from spontaneous falling.

And, as shown in FIG. 3, second rollers 30, having rotational axes at right angles with rotational axes of the first rollers 29, are attached to the sliding member 28 as to rotate and disposed as to hold a guide rail 18" parallel to the rotating male screw portion 26. The guide rail portion 18 is composed of the guide rails 18' and the guide rail 18", which are constructed as that the first rollers 29 prevent deviation (sheering and trembling) of the sliding member 28 (the seat 4) in back-and-forth direction and the second rollers 30 prevent the deviation in left-and-right direction.

Returning to FIG. 1, the seat frame 5 is a L-shaped supporting frame having a horizontal portion supporting the seat main body 7 horizontal and a vertical portion holding the back portion 10, and an armrest 20, laid horizontal and raised vertical, is attached to each of left and right sides of the vertical portion as to be oscillatable. And, a headrest 10*a*, detachable and position-changeable to correspond to the head height of the user, is disposed on an upper part of the back portion 10.

The driving mechanism M is disposed on an upper and a lower side of the post 38 respectively, the sliding member 28 as a component of the driving mechanism M is attached to the vertical portion of the seat frame 5 of the seat 4, and the seat 4 is elevated stably with the seat frame 5 guided by grooves on the post 38.

Figure 4:
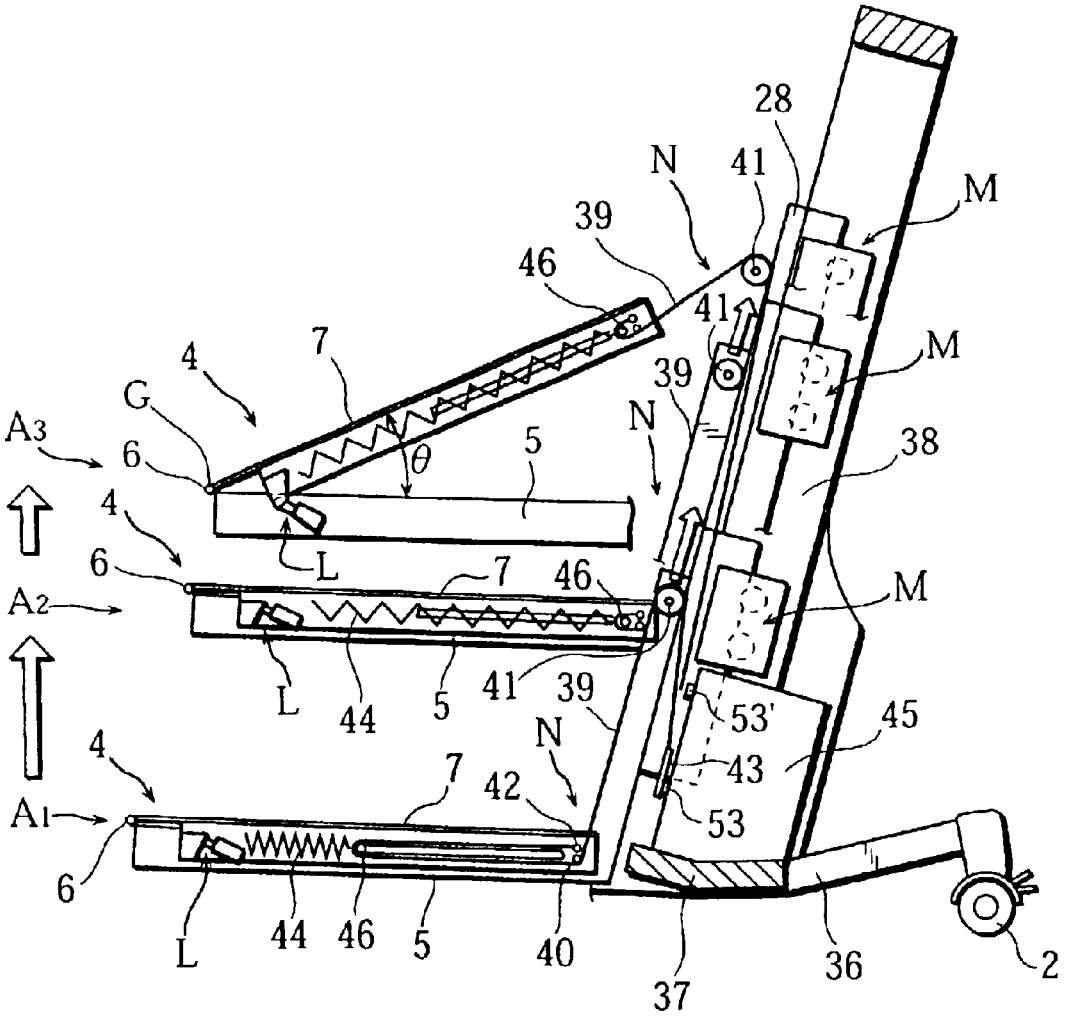
FIG. 4 is a cross-sectional side view showing the embodiment of the elevation chair of the present invention.

Next, in a side view of a principal portion of FIG. 4 showing the embodiment of the elevation chair (from which cushion material to be attached to the seat main body 7 and the back portion 10 are removed), the elevation chair has an oscillation mechanism N to elevate the seat 4 horizontally and automatically incline the seat main body 7 forward at a predetermined height. FIG. 4 shows the elevation and inclination of the seat 4.

The oscillation mechanism N is provided with a tension spring 44, a running pulley 46, a flexible member 39, a first pulley 40, and a second pulley 41. To describe in detail, an end of the flexible member 39 is attached to a supporting portion 42 on a rear end of the seat main body 7, and another end is attached to an attachment member 43 through the running pulley 46, the first pulley 40, and the second pulley 41. And, the attachment member 43 is hitched to a hitching member 53 of a fixation portion 45 fixed to the base member 37.

A long hole is formed on a side face of the seat main body 7, and the running pulley 46, guided and supported by the long hole as to be movable, is connected to an end of the tension spring 44 disposed in front of the seat main body 7. The tension spring 44 is set to be always pushing the running pulley 46 forward, giving tension to the flexible member 39, and stored in the seat main body 7 without laxation.

When the seat 4, in a state in which the seat main body 7 is held horizontal, namely, the state shown with a mark $A_1$, is ascended, the running pulley 46 is moved backward by the flexible member 39 along the long hole, and the running pulley 46 contacts a rear end of the long hole and stops when the seat 4 reaches a predetermined height to make a state shown with a mark $A_2$.

When the seat 4 is ascended further, the rear end of the seat main body 7 is raised along the ascension through the running pulley 46, the seat main body 7 is oscillated around an axis G to gradually incline forward, and the seat main body 7 is in a forward-inclined position with a predetermined inclination angle θ as shown with a mark $A_3$ when the seat 4 reaches a predetermined height.

The height, at which the seat main body 7 begins the inclination, can be changed by hitching the attachment portion 43 on the end portion of the flexible member 39 to another hitching portion 53 on the fixation portion 45 fixed to the base member 37. That is to say, the attachment member 43 as a component of the oscillation mechanism N has an adjustment mechanism F to change the forward-inclination starting height. And, although not shown in Figures, the number of the hitching members 53 and 53' may be 3 or more, and plural hitching holes may be formed on the flexible member 39 to be hitched onto a hitching piece on the fixation portion 45. With the adjustment mechanism F, the height at which the seat main body 7 begins the inclination is changed in plural stages.

Figure 6:
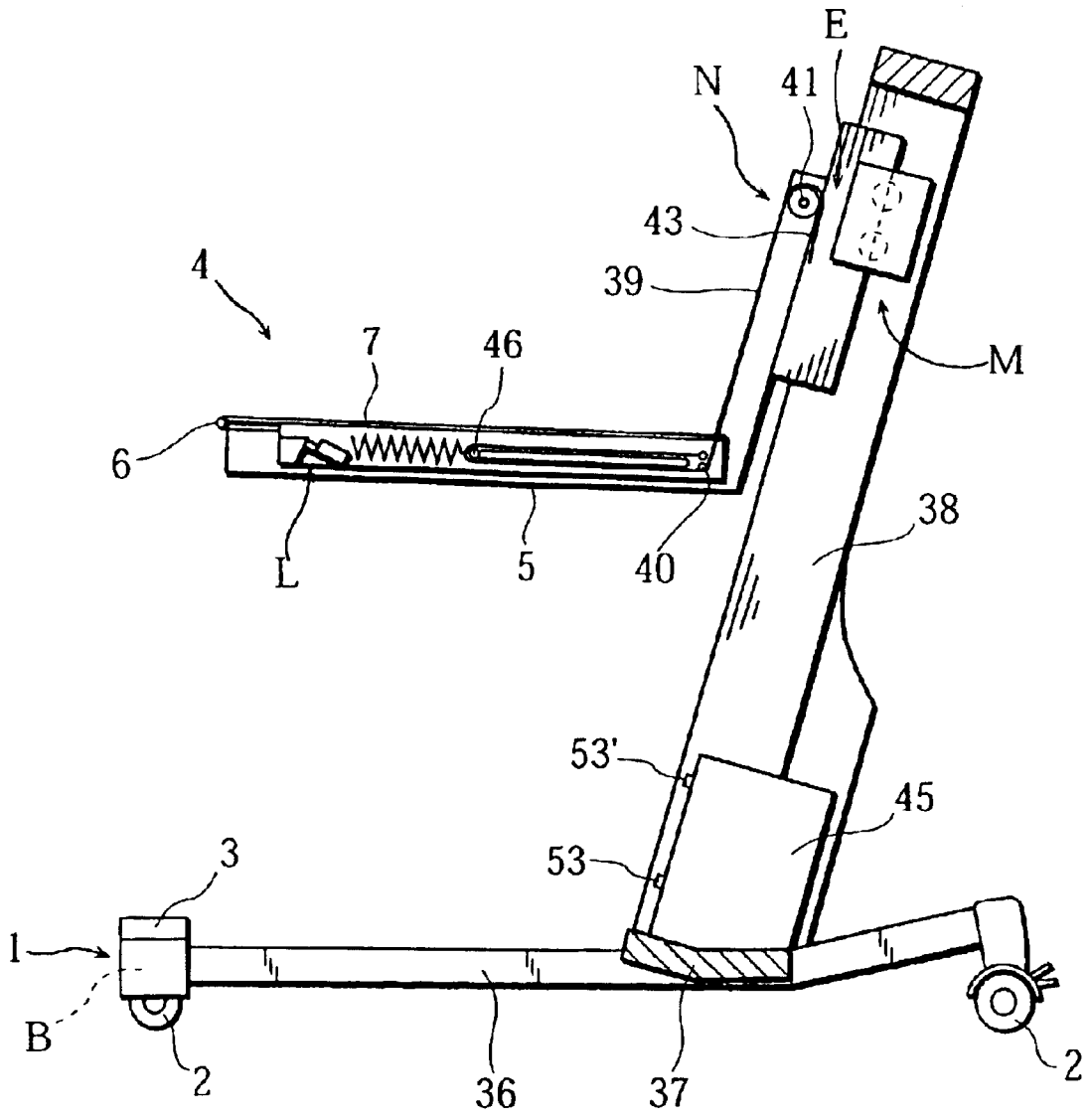
FIG. 6 is a cross-sectional side view showing still another embodiment of the elevation chair of the present invention.

And, as shown in FIG. 6, the attachment member 43 on the end portion of the flexible member 39 may not be hitched to the fixation portion 45 fixed to the base member 37, namely, may be freely ascended and descended to interrupt the automatic inclination of the seat main body 7 at the predetermined height, and the seat 4 can be elevated with horizontal state. That is to say, the attachment member 43 as a component of the oscillation mechanism N has a non-inclination switching mechanism E to interrupt the automatic forward inclination of the seat main body 7 and elevate the seat 4 with horizontal state.

Figure 5:
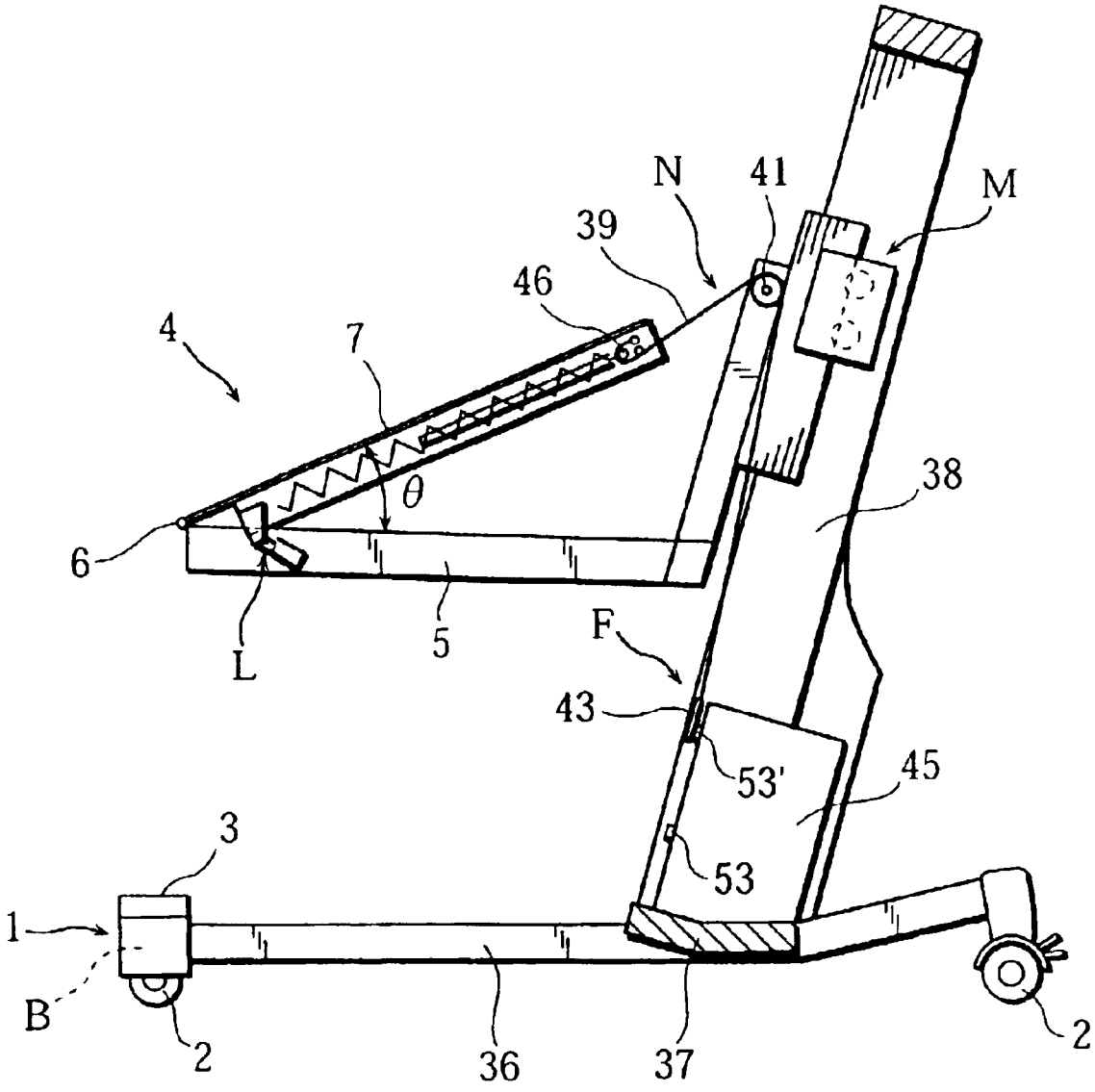
FIG. 5 is a cross-sectional side view showing another embodiment of the elevation chair of the present invention.

And, as shown in FIG. 4 and FIG. 5, the seat 4 has an angle detecting means L to stop the driving mechanism M when the seat main body 7 reaches the predetermined inclination angle θ. To describe in detail, as shown in FIG. 7 and FIG. 8, the angle detecting means L is provided with a shielding plate 8 and a photosensor 9 attached to the seat frame 5 to detect the inclination angle θ through an inclination angle of the shielding plate 8 which inclines along with the seat main body 7.

Figure 7:
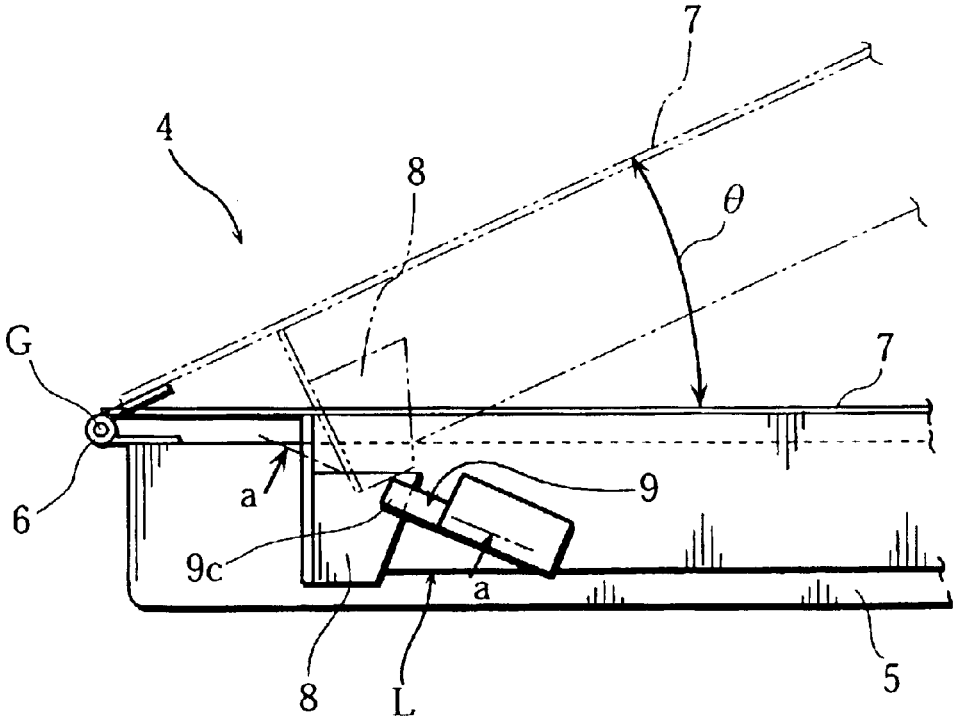
FIG. 7 is an enlarged cross-sectional view of a principal portion showing a component.
Figure 8:
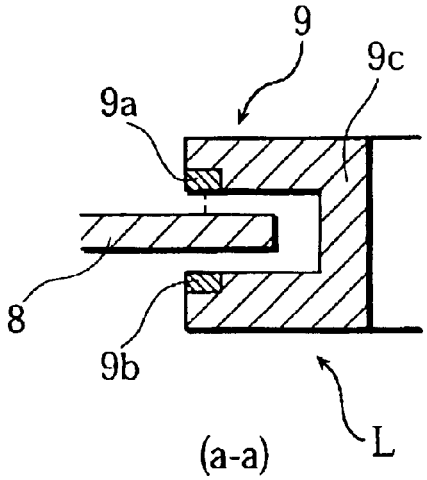
FIG. 8 is an enlarged cross-sectional view of a principal portion showing a component.

To describe further in detail, as shown in FIG. 7, in a state that the seat main body 7 (shown with solid lines) of the seat 4 is horizontal (the seat main body 7 and the seat frame 5 are overlapped in a side view), the photosensor 9 attached to the seat frame 5 is blocked by the shielding plate 8 attached to the seat main body 7. That is to say, as shown in a cross-sectional view of the angle detecting means L in FIG. 8, the shielding plate 8 is placed between an emission portion 9*a* and a receiving portion 9*b* disposed on a U-shaped main body 9*c*, and the driving mechanism M works when the photosensor 9 is switched off. Then, in a state that the seat main body 7 of the seat 4 inclines to the predetermined inclination angle θ (shown with two-dot broken lines in FIG. 7), the shielding plate 8 is departed from the photosensor 9 attached to the seat frame 5, the photosensor 9 is switched on to send a signal to a control circuit not shown in Figures, and the driving mechanism M is stopped.

And, the inclination angle θ of the seat main body 7 can be changed by changing the attached angle of the photosensor 9. The inclination angle θ, which is preferably 15° to 35°, is most preferably 25°. And, although not shown in Figures, the angle detecting means L may be composed of a micro switch and a contact piece which contacts and parts from a terminal of the micro switch.

Next, FIG. 9 through FIG. 12 show an automatic braking mechanism B mounted on the elevation chair. The wheels 2 are disposed front and rear portions on the elevation chair, and the automatic braking mechanism B is disposed on a position of each of the wheels 2 on the front portion (as shown in FIG. 1). The wheel 2 is released when a footrest 3 attached to the wheel bracket 1 of the wheel 2 is laid horizontal (as in FIGS. 11 and 12), and the wheel 2 is braked when the footrest 3 is raised upright (as in FIGS. 9 and 10).

To describe in detail, the automatic braking mechanism B has the footrest 3 of flat plate attached to the wheel bracket 1 as to held vertical by an elastic member 47. And, a front supporting shaft 11 is disposed on a front upper position of an axle 48 as to be parallel to the axle 48 and a rear supporting shaft 21 is disposed on a rear upper position of the axle 48 as to be parallel to the axle 48, and a front braking arm 12 having L-shaped cross section is attached to the front supporting shaft 11 as to oscillate and a rear braking arm 22 having L-shaped cross section is attached to the rear supporting shaft 21 as to oscillate.

Figure 9:
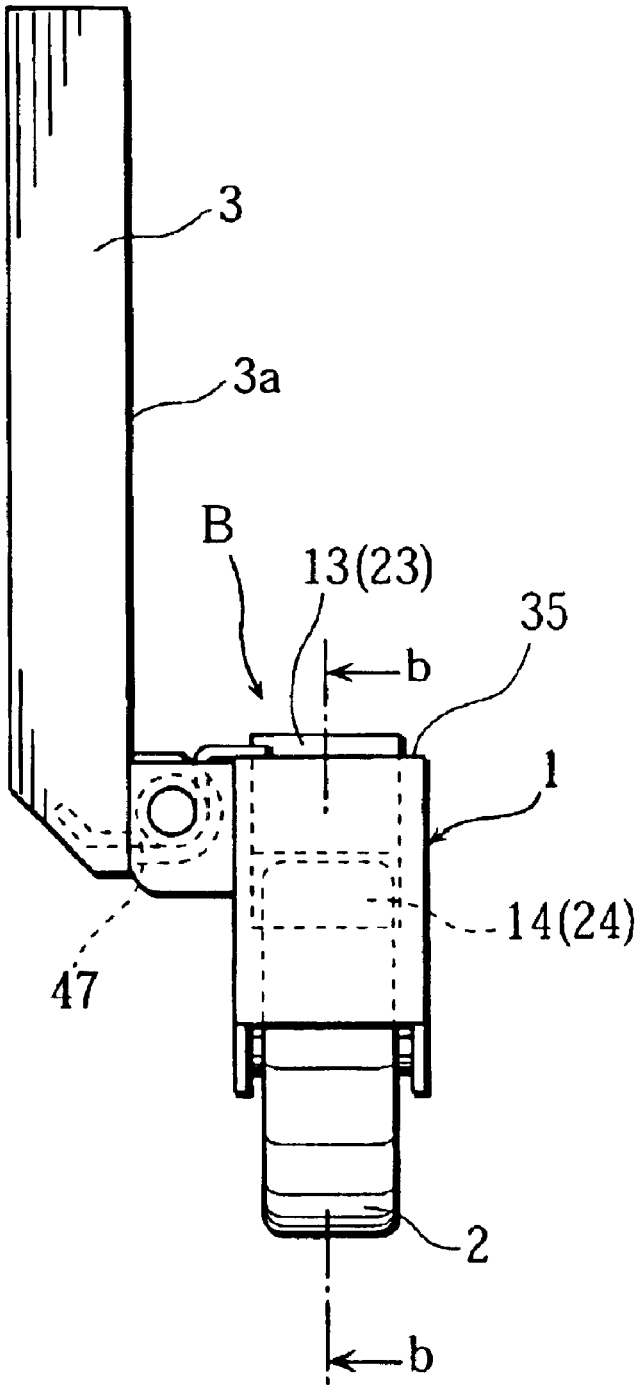
FIG. 9 is a front view showing a braking state of an automatic braking mechanism.
Figure 10:
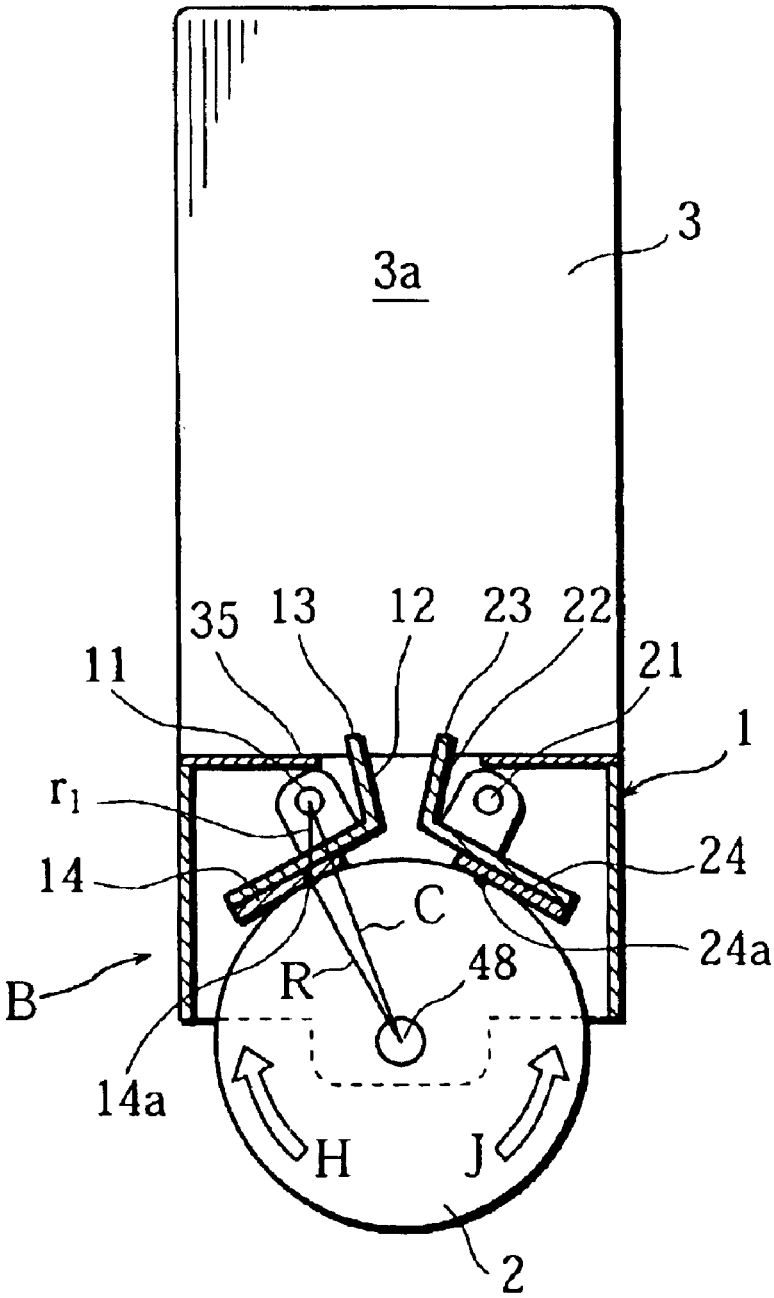
FIG. 10 is a cross-sectional side view showing the braking state of the automatic braking mechanism.

As shown in FIG. 9 and FIG. 10, a receiving portion 13 on an end of the front braking arm 12 and a receiving portion 23 on an end of the rear braking arm 22 are protruding from an opening on a top plate 35 of the wheel bracket 1, and a brake pad 14 attached on another end of the front braking arm 12 and a brake pad 24 attached on another end of the rear braking arm 22 are respectively pressed to front and rear parts of the wheel 2 by self weight of the front and rear braking arms 12 and 22, and the brake pads 14 and 24. That is to say, the brake pads 14 and 24 are pressed to the wheel 2 to brake the wheel 2 in the vertical upright state of the footrest 3. As shown in FIG. 9, widths of the brake pads 14 and 24 are larger than the width of the wheel 2 to slide on the whole width of the wheel 2 to enhance the braking ability by enlarging the sliding portion.

The automatic braking ability with the front and rear braking arms 12 and 22 is determined by positions of tangent points 14*a* and 24*a* of the brake pads 14 and 24 with the wheel 2 as shown in FIG. 10. That is to say, the tangent point 14*a* is an intersectional point of a radius R of the wheel 2 and an oscillation radius $r_1$ of the front braking arm 12, and a distance C, between the front supporting shaft 11 of the front braking arm 12 and the axle 48, is set to be smaller than a sum of the radius R of the wheel 2 and the oscillation radius $r_1$ of the front braking arm 12. Therefore, when the wheel 2 starts rotation in clockwise direction H in FIG. 10, the brake pad 14 presses toward the center of the wheel 2 in the radius R direction to enhance the braking ability by frictional force. This automatic braking function stops the rotation in the clockwise direction H of the wheel 2.

In this case, the front braking arm 12 is free from rotation of the wheel 2 in anti-clockwise direction J. The wheel 2 can run while the brake pad 14 is sliding on a rotating face of the wheel 2 (without braking). Therefore, in the automatic braking mechanism B, the rear braking arm 22 is disposed on a position symmetric to the front braking arm 12 with respect to a vertical line going through the axle 48, the rotation of the wheel 2 in the anti-clockwise direction J is prevented by the braking function to prevent the wheel 2 from moving in back-and-forth direction.

Figure 11:
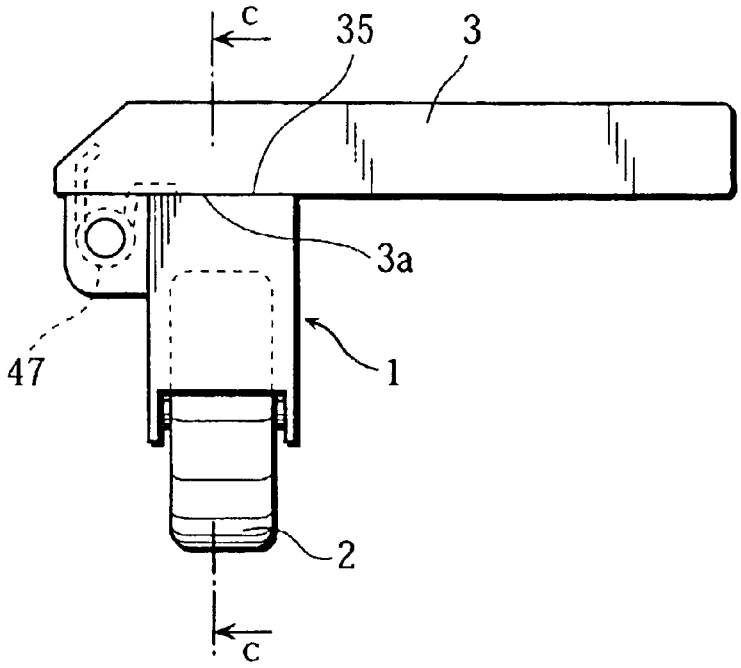
FIG. 11 is a front view showing a non-braking state of the automatic braking mechanism.
Figure 12:
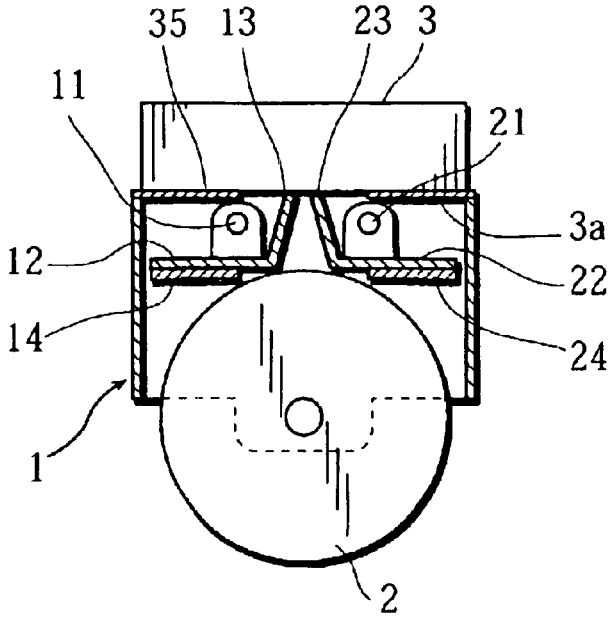
FIG. 12 is a cross-sectional side view showing the non-braking state of the automatic braking mechanism.
Figure 13:
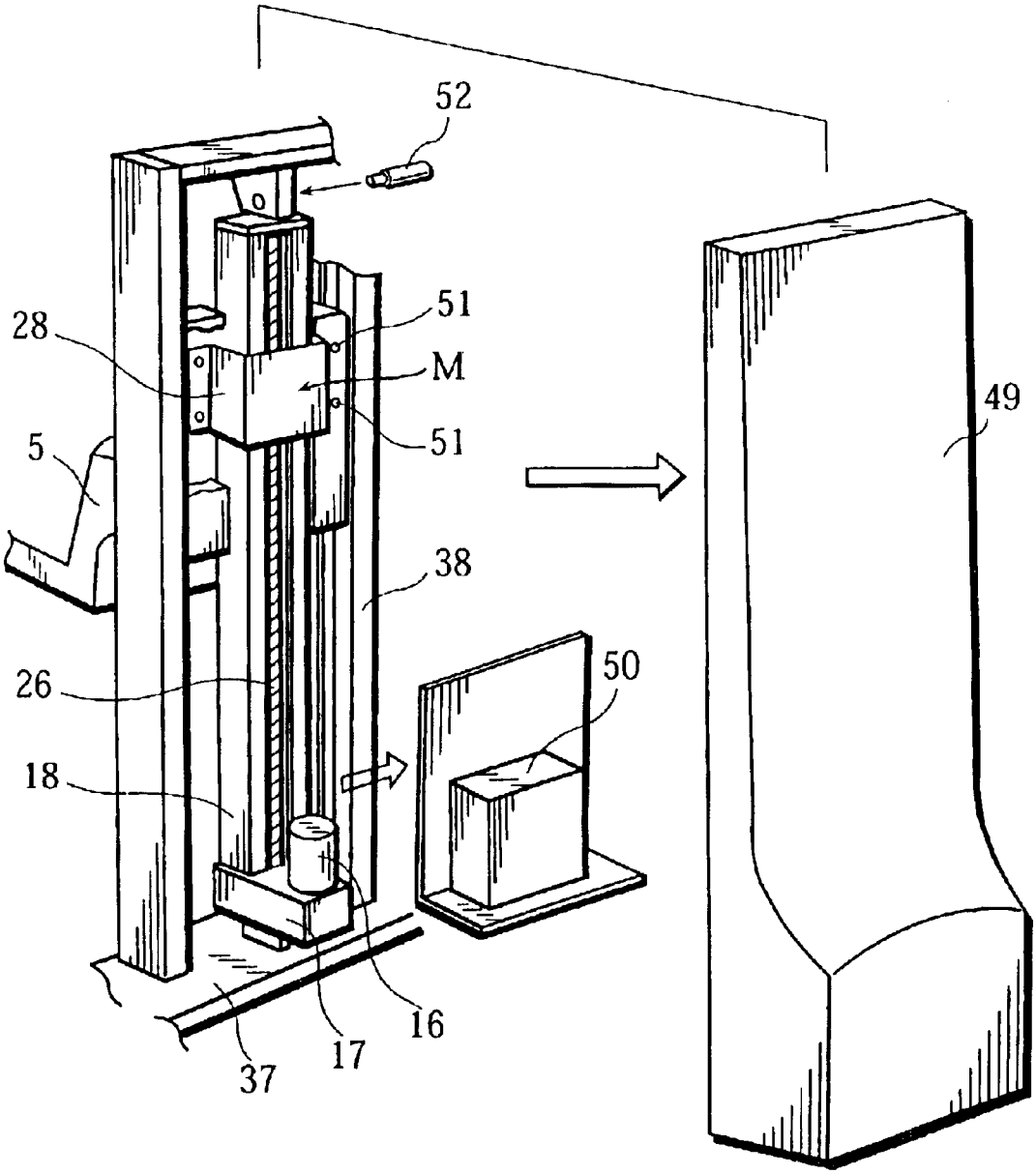
FIG. 13 is a rear perspective view in which the elevation chair is disassembled.

Next, as shown in FIG. 11 and FIG. 12, in the state that the footrest 3 is laid horizontal, a reverse face 3*a* of the footrest 3 faces the top plate 35 of the wheel bracket 1 and pushes the receiving portions 13 and 23 down, the front and rear braking arms 12 and 22 oscillate around the front and rear supporting shafts 11 and 21, and the brake pads 14 and 24 are parted from the wheel. Then, the wheel 2 can run and the chair can freely move back and forth. To lay the footrest 3 horizontal, the self weight of the footrest 3 overcomes the elastic force of the elastic member 47, attached to the footrest 3, to lay down the footrest 3.

The footrest 3, larger than the width of the wheel 2 (the wheel bracket 1) as shown in FIG. 9 and FIG. 11, has a sufficient size as shown in FIG. 1 with which a person can put the foot when sitting on the seat 4. Therefore, the footrest 3 must be raised upright as shown in FIG. 9 when a person sits on and stands up because the large footrest 3 occupies footspace necessary for sitting and standing. That is to say, the footrest 3 must be raised upright and brake locking (braking) is certainly conducted. With this mechanism, the person is prevented from falling when sits on and stands from the seat by the braking of the wheel 2 without spontaneous backward movement of the chair. And, injury caused by dragging is prevented by putting the foot on the footrest 3 when the person sitting on the seat 4 is transferred.

As described above, the driving mechanism M for elevating the seat 4 is provided with the motor 16, the reducer portion 17, the guide rail portion 18, the rotating male screw portion 26, the sliding female screw portion 27, and the sliding member 28, and united as a unit. When the elevation chair of the present invention (the driving mechanism M) is maintained, a cover 49 and an electric portion 50 are removed from the main body of the chair, fixation screws 51 to fix the driving mechanism M to a vertical portion of the seat frame 5 are unscrewed to remove the driving mechanism M as one unit from the post 38. That is to say, the driving mechanism M to be maintained can be removed from the main body of the chair without disassembly into individual parts.

And, to facilitate the removal from the main body of the chair, an upper part of the driving mechanism M is pinned to an upper part of the post 38 with a fixation member 52, and, although not shown in Figures, a lower part has a hook-shaped hitching portion to be hitched to a lower part of the post 38. Therefore, the driving mechanism M can be taken out of the post 38 only with removal of the fixation member 52.

Figure 14:
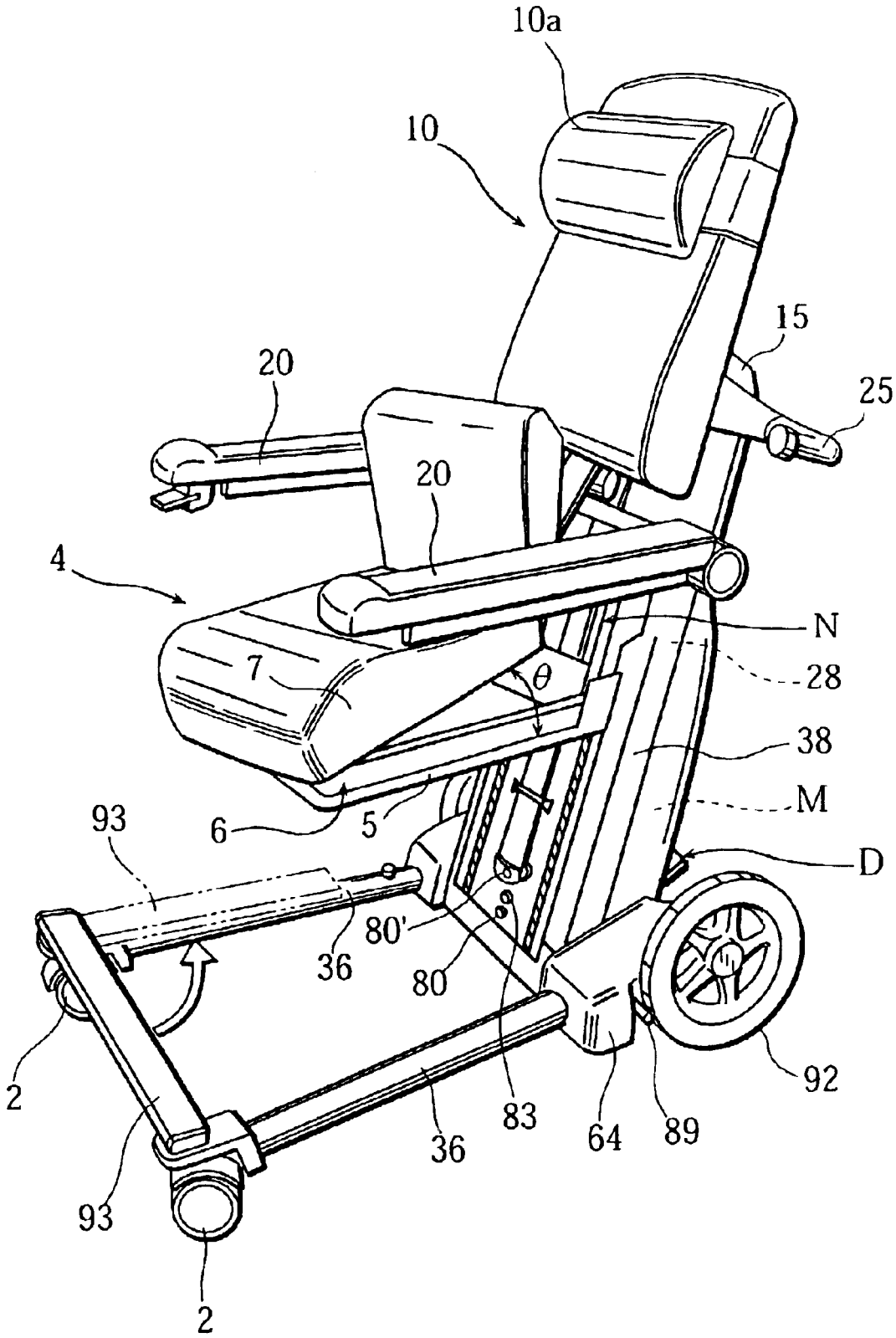
FIG. 14 is a perspective view showing a further embodiment of the elevation chair of the present invention.

Next, another embodiment of the elevation chair of the present invention as shown in a perspective view of FIG. 14 is described. This elevation chair, similar to the elevation chair described with FIG. 1, has a seat 4 which is elevated (lifted) and inclined, and runs on floor, etc. A lower portion of the elevation chair is provided with a lower fixation portion 64 as a base portion to hold the post 38, having leg portions 36 connected to the front of the lower fixation portion 64 on left and right sides. Wheels 2 are attached to forth end portions of the leg portions 36 and wheels 92 are attached to the lower fixation portion 64 on the left and right sides as to rotate. The posy 38 is placed on and fixed to the lower fixation portion 64 as to incline backward, and a driving mechanism M, to elevate (ascend and descend) the seat 4 and a back portion 10 (a sliding member 28), is detachably attached to the post 38.

A battery 15 is mounted on the post 38 to independently conduct elevation and inclination of the seat 4 of the elevation chair electrically. A handle 25 for transfer is disposed on a rear side of the post 38 to easily transfer (move) the elevation chair. And, as described later in detail, a pedal braking mechanism D is mounted behind the lower fixation portion 64 to brake the wheels 92 and certainly fix the position of the elevation chair.

The seat 4 is provided with a seat frame 5 and a seat main body 7 attached to a forth end portion 6 of the seat frame 5 as to incline forward. The seat 4, keeping horizontal state, is elevated (lifted up and down) by the driving mechanism M, and the seat main body 7 is inclined forward by an oscillation mechanism N at a predetermined height. The seat 4 is connected to the sliding member 28 elevated along the post 38 to be elevated.

Figure 15:
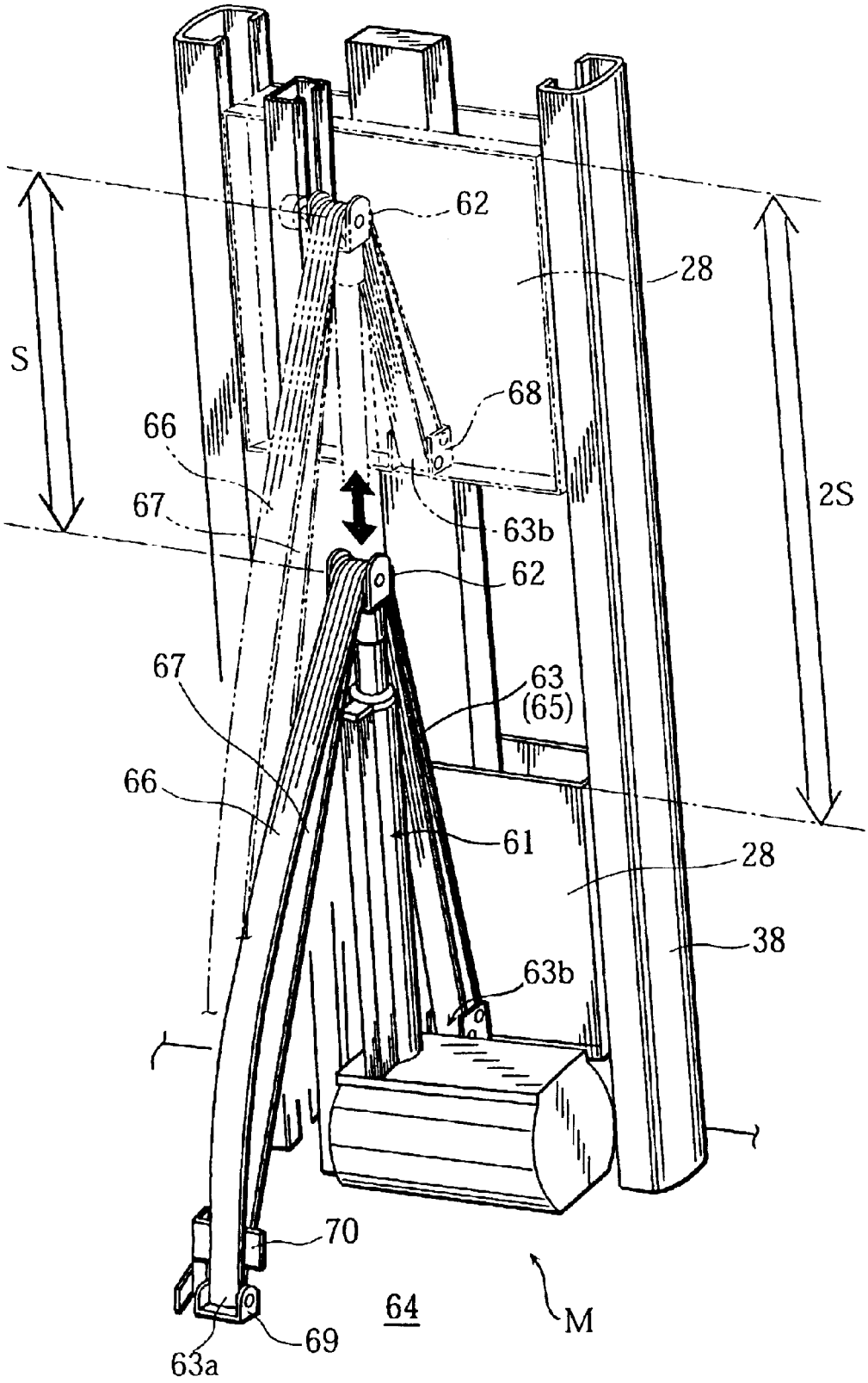
FIG. 15 is a perspective view for explanation of a driving mechanism.

The driving mechanism M to elevate the seat 4, as shown in FIG. 15, is provided with the elevatable sliding member 28 to which the seat 4 is connected, an expansion actuator 61 which expands and contracts up and down, a running rotation pulley 62 disposed on an upper end of the expansion actuator 61, and a flexible member 63. The flexible member 63, of which end 63*a* is attached to a fixation metal 69 of the lower fixation portion 64, is expanded upward and suspended on the running rotation pulley 62, and another end 63*b* of the flexible member 63 is attached to an attachment metal 68 of the sliding member 28 situated low.

As shown in FIG. 15, to obtain necessary elevation stroke (2× S) of the sliding member 28 (the seat 4), the running rotation pulley 62 on the upper end of the expansion actuator 61 is moved for a half of the stroke (S) because the running rotation pulley 62 on the expansion actuator 61 serves as a running pulley.

With this pulley device, elevation movement dimension of the running rotation pulley 62 as a component of the driving mechanism M can be diminished. Vertical dimension and expansion length of the expansion actuator 61 can be made small, and the device is made compact and light. Therefore, the elevation chair can be light-weight, moved easily, and handled properly.

The flexible member 63 is composed of a flexible belt 65 having a double-suspension construction in which an outer belt 66 and an inner belt 67 are layered. In normal working, the inner belt 67 is suspended to be tensed as to suspend the sliding member 28 (the seat 4) from the fixation metal 69 (the lower fixation portion 64) through the running rotation pulley 62 as shown in FIG. 15, and the outer belt 66 is untensed and suspended on the lower fixation portion 64, the running rotation pulley 62, and the sliding member 28. That is to say, in normal working, only the inner belt 67 suspends the sliding member 28 to elevate with the expansion actuator 61.

Figure 16:
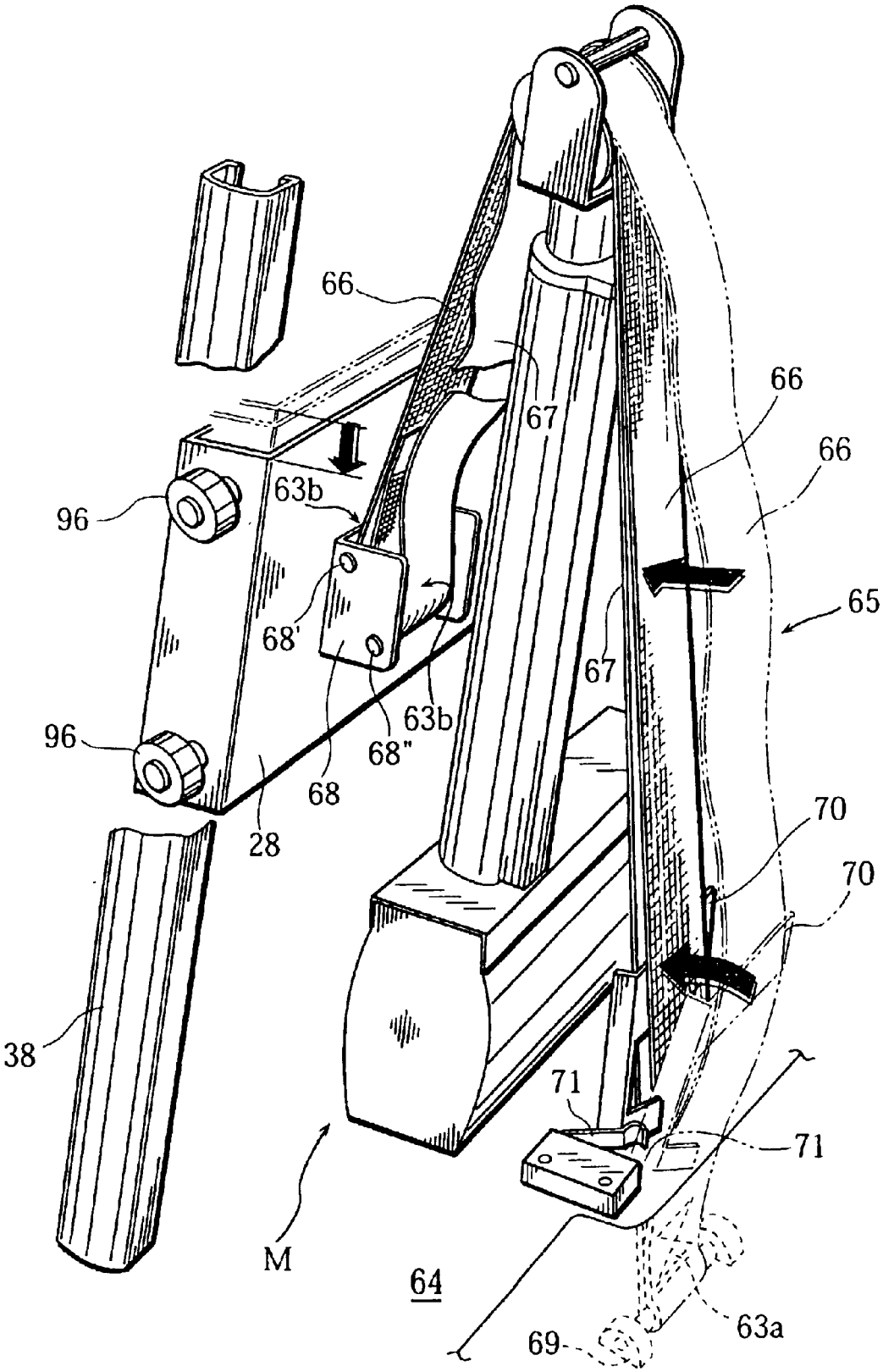
FIG. 16 is a perspective view for explanation of the driving mechanism.

And, a safety device is constructed as that in emergency in which overload is generated by malfunction of the expansion actuator 61, and the inner belt 67 is broken by aging, as shown in FIG. 16, the outer belt 66, suspended in loose state, is tensed to suspend the sliding member 28 and retain the position (prevent falling).

As shown in FIG. 16, the sliding member 28 is provided with two rollers 96 on each of upper and lower positions to elevate along the guide rails of the post 38 to smoothly elevate the sliding member 28 without trembling.

As shown in FIG. 15 and FIG. 16, a position-corresponding plate 70 is disposed between the outer belt 66 and the inner belt 67. The position-corresponding plate 70 is pushed to press the outer belt 66 in normal working to hold the outer belt 66 as not to be excessively loosened. And, as shown in FIG. 16, in emergency in which the inner belt 67 is broken, the outer belt 66 is tensed to suspend the sliding member 28 to retain the position and push the position-corresponding plate 70 to the inner belt 67 side to change the position. Then, the position-corresponding plate 70 contacts a detecting portion of a displacement detecting mechanism 71 (a limit switch) to stop (by electric shielding) the expansion actuator 61 of the driving mechanism M.

Therefore, even if the inner belt 67 is broken by overload generated by the expansion actuator 61, the expansion actuator 61 does not break the outer belt 66, and the seat 4 is (although slightly descended by idle length of the outer belt 66) suspended and held.

And, as shown in FIG. 16, the outer belt 66 and the inner belt 67 are attached to the attachment metal 68 of the sliding member 28 at different heights. In production of the flexible belt 65, a belt is folded at the middle which is an end 63*a*, and two ends on the opposite side are ends 63*b*. These two belts are the outer belt 66 and the inner belt 67. The end 63*b* on the outer belt 66 side is attached to an upper pin 68' of the attachment metal, and the inner belt 67 side is attached to a lower pin 68". Therefore, the outer belt 66 is naturally loosened when the inner belt 67 is tensed. The flexible belt 65 is easily made thereby without error in assembly. And, the belt does not fall out of the lower fixation portion 64 when the inner or the outer belt is tensed because the folded portion is formed into a loop by sewing.

Next, in inclination movement of the seat main body 7 in the embodiment shown in FIG. 14, although the seat main body 7 is inclined as in FIGS. 4, 5, and 6 similar to that of the embodiment shown in FIG. 1, a suspension belt 78 (corresponding to the flexible member 39 in FIG. 4) of the oscillation mechanism N is differently composed from the embodiment in FIG. 1.

Figure 17:
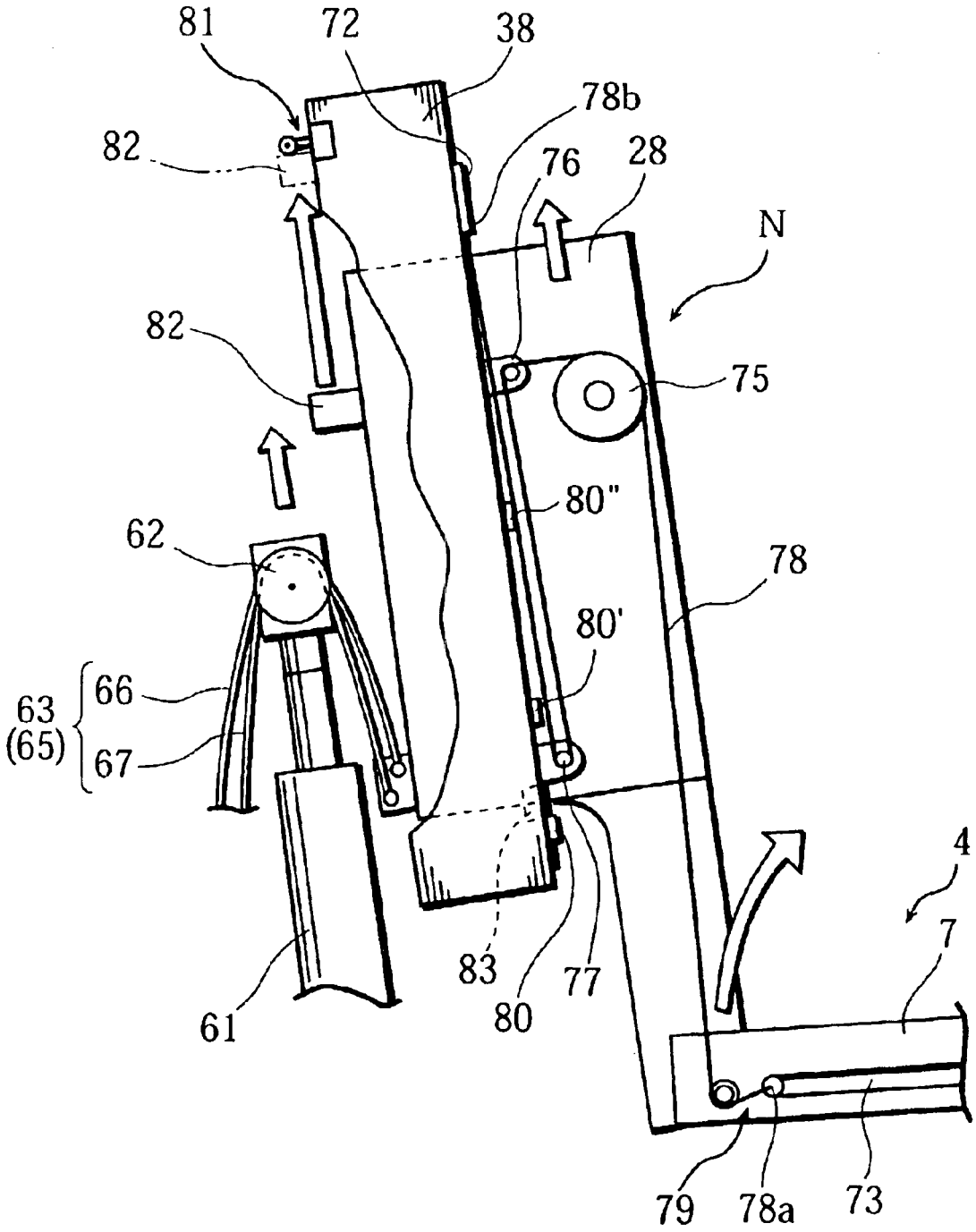
FIG. 17 is a cross-sectional side view showing the driving mechanism and an oscillation mechanism.

To describe in detail with FIG. 17, the oscillation mechanism N is provided with an elevation pulley 75 attached to the sliding member 28, a middle deflection shaft 76 attached the post 38, and a hook 77 with a deflection shaft hitched to a hitching protruding portion 80. The suspension belt 78 raises the seat main body 7 as to incline forward with this pulley mechanism by elevation movement of the elevation pulley 75 of the sliding member 28. To compose the suspension belt 78, an end portion 78*a* is connected to a rear end portion 79 of the seat main body 7 to suspend (composed similar to the embodiment in FIG. 1), and another end portion 78*b* is fixed to a fixation metal 72 on an upper portion of the post 38. And, the suspension belt 78 extends upwards from the end portion 78*a* to be suspended on the elevation pulley 75 and on the middle deflection shaft 76, then, extends downwards to be suspended on the hook 77 with the deflection shaft and connected to the upper fixation metal 72.

With this construction, an elevation movement stroke of the sliding member 28 (the elevation pulley 75) to incline the seat main body 7 is required to be only a half of that when the seat main body 7 is directly raised because the elevation pulley 75 elevated by the sliding member 28 works as a running pulley.

The hook 77 with the deflection shaft, as described later, can change the height of hitching position, although not shown in Figures, only by hitching a hole on the hook 77 to the hitching protruding portion 80 of the post 38. The hook 77 with the deflection shaft is always pulled up by the suspension belt 78 to prevent the hook 77 from falling off the hitching protruding portion 80. So the hook 77 with the deflection shaft is positioned lower than the elevation pulley 75, and the end portion 78*b* of the belt 78 is fixed to the upper fixation metal 72 to make a loop of the belt.

Further, the middle deflection shaft 76 is disposed as the suspension belt 78, between the middle deflection shaft 76 and the hook 77 with the deflection shaft, is pulling the hook 77 with the deflection shaft always in a constant direction, and the hook 77 with the deflection shaft receives a component of tensile force. The hook 77 with the deflection shaft is prevented from falling out of hitching, and having a simple construction, not receiving strong bending force, which can resist only tensile force in one direction.

The suspension belt 78, unstretchable and having a constant length, raises the seat main body 7 to be inclined forward with the pulley mechanism. As the oscillation mechanism N to make the movement, an adjustment mechanism F which can change the height at which the inclination of the seat main body 7 begins corresponding to height of the person who sits on the seat 4. The adjustment mechanism F, composed of hitching protruding portions 80 and 80' disposed on different heights on the front side of the post 38 to which the hook 77 with the deflection shaft is hitched, expands application range of the elevation chair corresponding to the difference of the height.

To describe concretely, as shown in FIG. 17, the hitching protruding portions 80 and 80' are disposed on the front side of the post 38 on plural stages (two stages) in vertical direction. Then, the length that the end portion 78*a* of the suspension belt 78 contacts the rear end portion of the long hole 73 on the seat main body 7 to raise the seat main body 7 is changed by changing the hitching height of the hook 77 with the deflection shaft from the protruding portion 80 to the protruding portion 80' (or from the protruding portion 80' to the protruding portion 80) to change the height at which the forward inclination begins.

When the hook 77 with the deflection shaft is hitched to the protruding portion 80, the seat main body 7 starts the inclination at an early (a lower) predetermined position for a short person. When the hook 77 with the deflection shaft is hitched to the protruding portion 80', the seat main body 7, later than the case of the protruding portion 80, starts the inclination at a higher position for a tall person. With the construction of the running pulley including the elevation pulley 75 described above, the difference of the height, at which the inclination begins, between for the short person and for the tall person is the twice of the difference of height between the protruding portion 80 and the protruding portion 80'.

Further, the seat 4 can be kept horizontal when elevated without the automatic forward inclination of the seat main body 7 at the predetermined height by changing the hitching height of the hook 77 with the deflection shaft to the position of a hitching protruding portion 80" (the uppermost stage) disposed further (a non-inclination switching mechanism E). When the hook 77 with the deflection shaft is hitched to the upper predetermined position, the end portion 78*a* of the sliding member 78 does not contact the rear end portion of the long hole 73, and the rear end portion 79 of the seat main body 7 is not raised even if the sliding member 28 ascends to the uppermost portion.

To detect a height position of the seat main body 7 (the sliding member 28) at which the seat main body 7 is stopped after the elevation and forward inclination, the expansion actuator 61 itself detects the elevation stroke S, stops its expansion movement, and the inclination of the seat main body 7 is stopped. As another method, as shown in FIG. 17, a position detecting mechanism 81 such as a limit switch is disposed on the post 38, a protruding piece 82 on the sliding member 28 contacts the position detecting mechanism 81 when elevated to a predetermined height, and the driving mechanism M (the expansion actuator 61) is stopped by the position detecting mechanism 81.

And, as shown in FIG. 14 and FIG. 17, a working switch 83 is disposed near (above) the protruding portion 80 on the post 38. When the hook 77 with the deflection shaft hitches to the protruding portion 80, the hook 77 with the deflection shaft pushes the working switch 83 to electrically switch on the position detecting mechanism 81 (the limit switch) above.

In the case that a two-staged height adjusting mechanism is applied (for short and tall persons) as described above, a two-staged upper limit position detecting means is required. To describe concretely a stopping mechanism for the driving mechanism M, when the hook 77 with the deflection shaft is hitched to the protruding portion 80 for a short person, the hook 77 with the deflection shaft pushes the working switch 83 to electrically switch on the position detecting mechanism 81 (the limit switch) above, the sliding member 28 is elevated by the driving mechanism M, the protruding piece 82 on the sliding member 28 contacts the position detecting mechanism 81 at the predetermined height to stop the driving mechanism M (the expansion actuator 61).

When the hook 77 with the deflection shaft is hitched to the protruding portion 80' for a tall person, the position detecting mechanism 81 (the limit switch) is electrically switched off, the detection is not conducted when the protruding piece 82 contacts the position detecting mechanism 81, the sliding member 28 is elevated further, then, the expansion actuator 61 itself detects the predetermined elevation stroke to stop its expansion movement.

Figure 18:
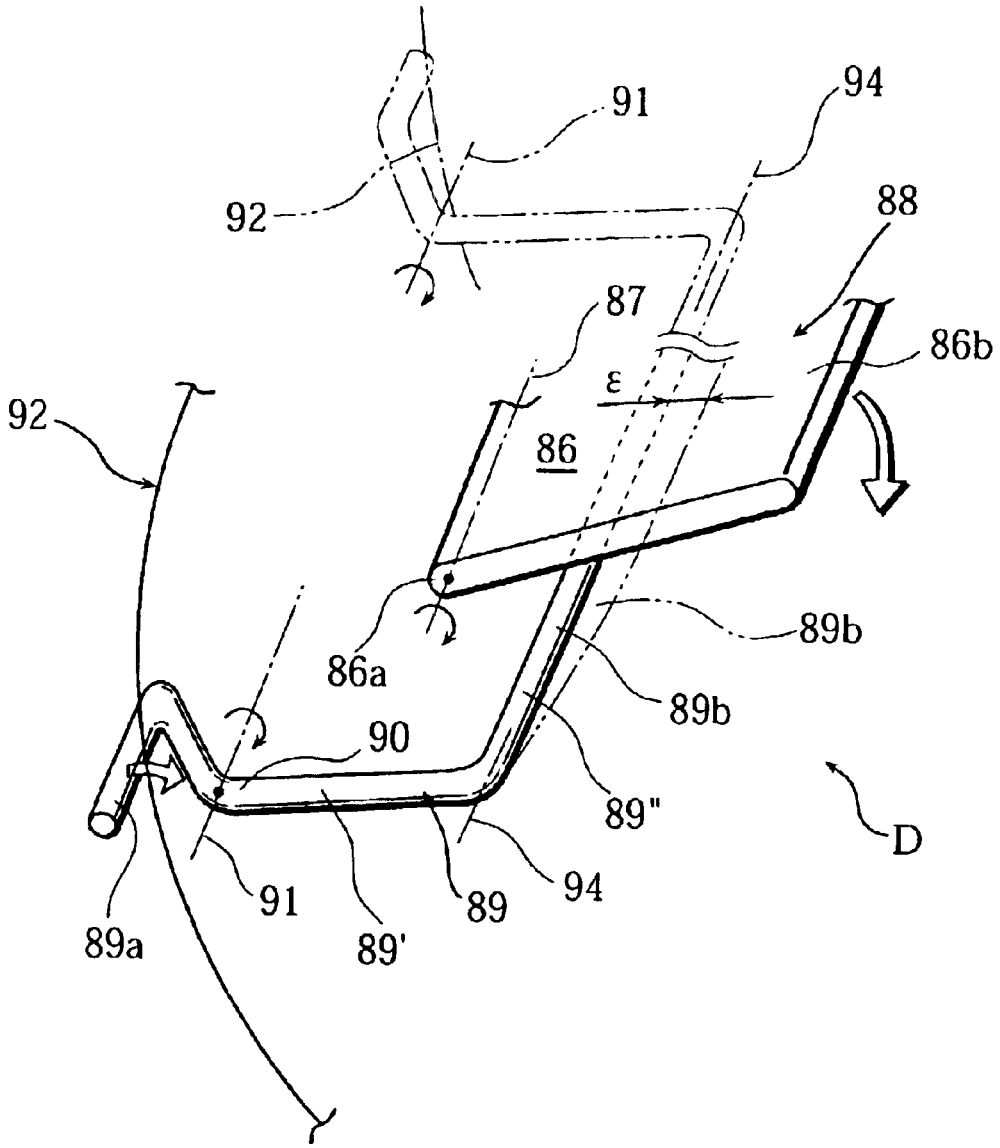
FIG. 18 is a perspective view showing a pedal braking mechanism.
Figure 19:
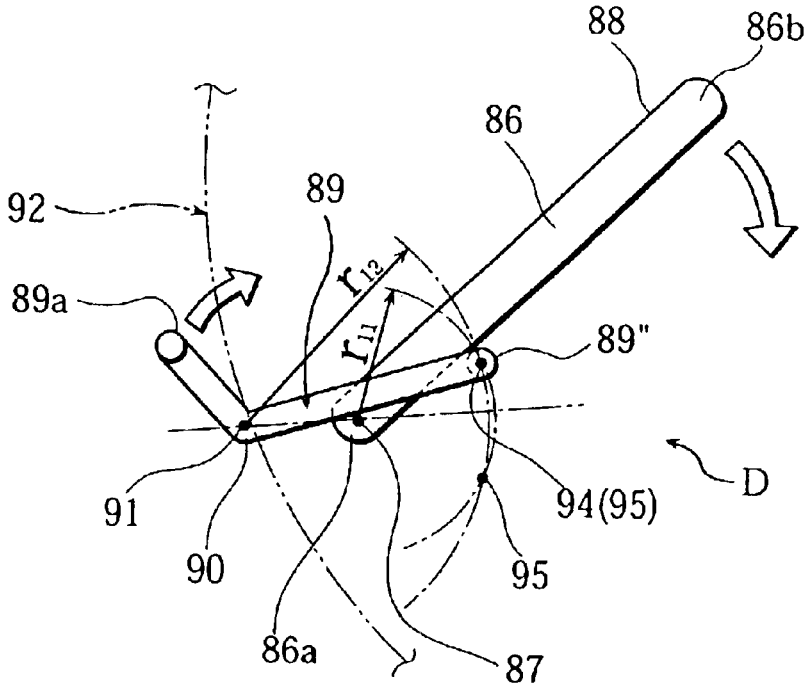
FIG. 19 is a side view showing a non-braking state of the pedal braking mechanism.
Figure 20:
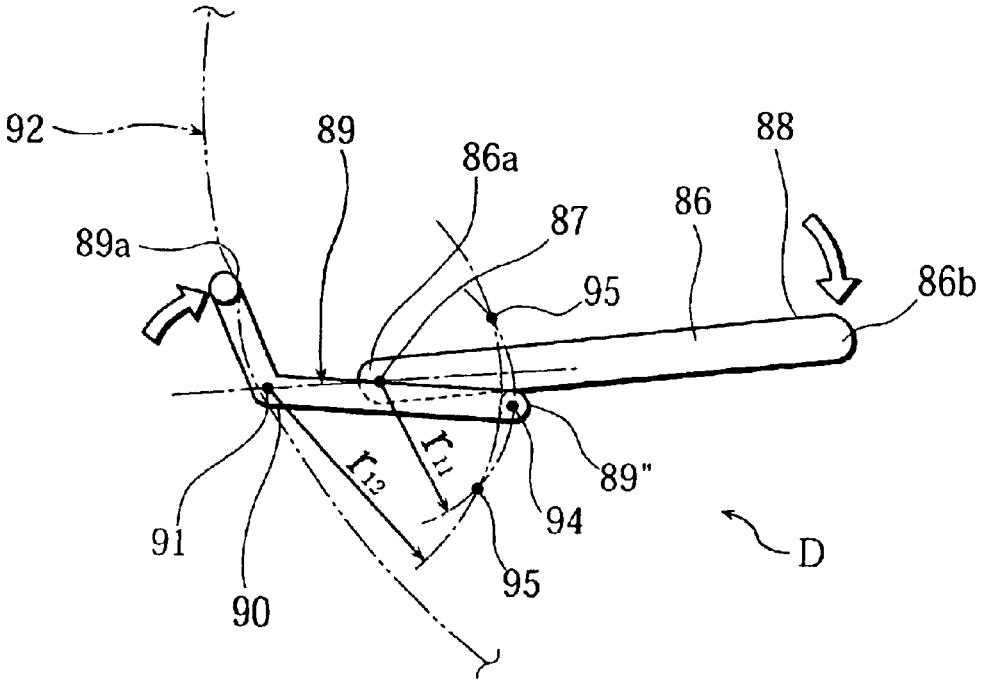
FIG. 20 is a side view showing a braking state of the pedal braking mechanism.

Next, the pedal braking mechanism D, disposed behind the elevation chair in FIG. 14, is described. A schematic perspective view is shown in FIG. 18, and FIGS. 19 and 20 are side views. In FIG. 18, rotation of the wheel 92 on the rear side is restricted by pressing an end portion 89*a* of a brake shaft 89 to the wheel 92. Although FIG. 18 mainly shows the wheel 92 on the left side, the wheel 92 on the right side has a similar and symmetric construction. That is to say, the brake shaft 89 is a rod-like member bent U-shaped approximately.

The braking mechanism D is provided with a brake pedal 86 of plate and the rod-like metal brake shaft 89. An end portion 86*a* of the brake pedal 86 is attached to an inner portion of the lower fixation portion 64 on the rear side as to oscillate around a first horizontal axis 87 in lateral direction, and an operation pedal portion 88 is disposed on another end portion 86*b* (another end side portion) as to protrude outward from the lower fixation portion 64.

The U-shaped rod-like brake shaft 89 is provided with a leg portion 89', namely, a supporting rod in proceeding direction of the chair, and a back portion 89", namely, a horizontal beam in lateral direction. A middle portion 90 of the leg portion 89' of the brake shaft 89 is attached as to oscillate around a second horizontal axis 91 in lateral direction near the wheel 92 of the lower fixation portion 64, and the end portion 89*a* of the leg portion 89' can contact the wheel 92 with the oscillation movement of the brake shaft 89 around the second horizontal axis 91 to brake the wheel 92. The back portion 89" of the brake shaft 89 is attached to the lower face side of the brake pedal 86 on a position on the operation pedal portion 88 side toward the position of the first horizontal axis 87, and, as shown in the side view of FIG. 19, out of an imaginary line going through the first horizontal axis 87 and the second horizontal axis 91 (above the imaginary line in FIG. 19), and oscillatable around a third horizontal axis 94 along with the brake pedal.

And, when the operation pedal portion 88 of the brake pedal 86 in FIG. 19 is stamped by foot to oscillate around the first horizontal axis 87 as to become the state in FIG. 20, as shown in FIG. 18, the back portion 89" of the brake shaft 89, being pulled and elastically deformed (for a displacement $\epsilon$), is oscillated around the second horizontal axis 91 to brake the wheel 92. Similarly, the operation pedal portion 88 of the brake pedal 86 in FIG. 20 is pulled up by foot as to become the state in FIG. 19 to release the brake.

The elastic deformation of the back portion 89 " of the brake shaft 89 works to keep the braked state and the released state. Especially, in the braked state, the wheel 92 is firmly pressed by elastic force with the end portion 89*a*.

This position retaining work is caused by elastic work of the brake shaft 89 (the back portion 89") made of metal, and, as shown in FIG. 19 and FIG. 20, difference between an oscillation radius $r_{11}$ of the first horizontal axis 87 and the third horizontal axis 94 of the brake pedal 86 and an oscillation radius $r_{12}$ of the second horizontal axis 91 and the third horizontal axis 94 of the brake shaft 89, namely, the oscillation radius $r_{12}$ is longer than the oscillation radius $r_{11}$.

And, the connecting point of the brake shaft 89 and the brake pedal 86 (the third horizontal axis 94) passes an imaginary line going through the first horizontal axis 87 and the second horizontal axis 91, and the brake shaft 89 becomes static on two intersection points 95 of two different arc traces without elastic deformation. That is to say, the connecting point above (of the third horizontal axis 94) between the two intersection points 95 automatically returns to one of the two intersection points 95 with elasticity.

Returning to FIG. 14, a footrest 93 of plate is disposed above the forward wheels 2 as to be position-changeable. In the state shown in FIG. 14, a person sitting on the seat 4 can put the feet on the footrest 93 to prevent the feet from dragging in transfer. And, the position of the footrest 93 is changed parallel to the leg portion 36 not to hinder the person to get on and off the seat 4.

Figure 21:
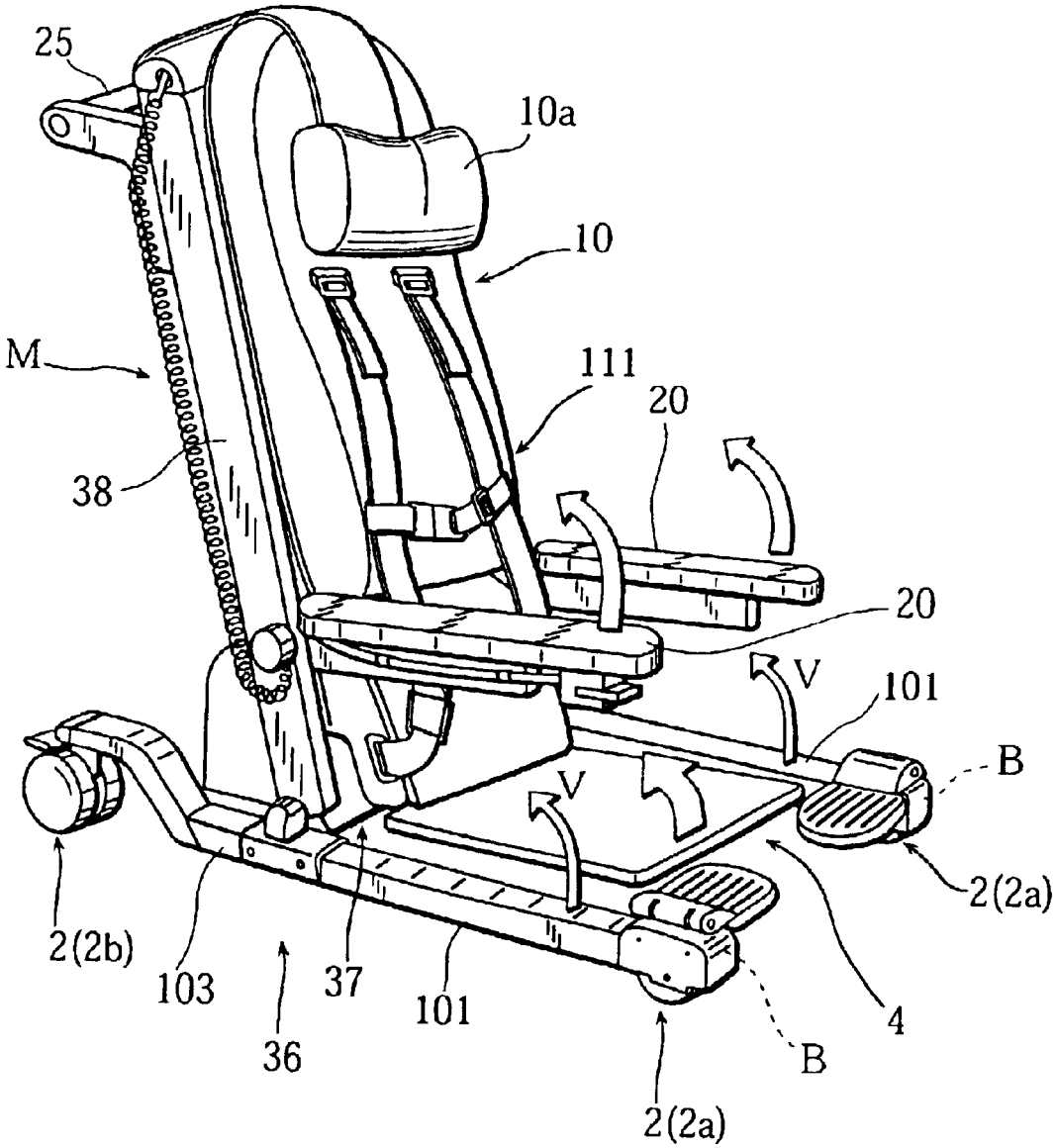
FIG. 21 is a perspective view showing another embodiment of the elevation chair of the present invention.

Next, FIG. 21 is a perspective view showing another embodiment of the elevation chair of the present invention. This elevation chair, similar to the elevation chair described with FIG. 1 and FIG. 14, runs (moves) on the floor and has a seat 4 elevated (ascended and descended) by the driving mechanism M as described above. A lower part of the elevation chair is provided with a base member 37 to hold a post 38, horizontal leg portions 36 are disposed both sides of the base member 37, and wheels 2 are disposed on front positions and rear positions of the leg portions 36 as the elevation chair has 4 wheels.

The leg portion 36 is composed of a rear fixation portion 103 and a front oscillation arm portion 101 which is before the base member 37. The oscillation arm portion 101 is a horizontal supporting member protruding forward, and a front wheel 2*a* is attached to a forth end of the oscillation arm portion 101. And, the front wheel 2*a*, with a rear wheel 2*b* attached to the rear fixation portion 103, supports the elevation chair stably as to run.

Figure 22:
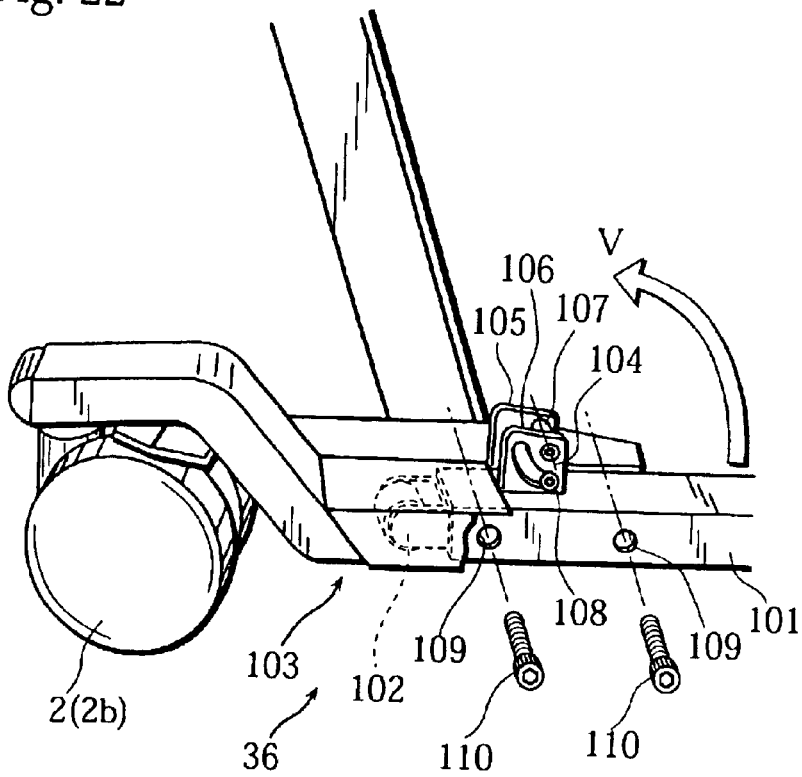
FIG. 22 is a perspective view to explain a leg portion.
Figure 23:
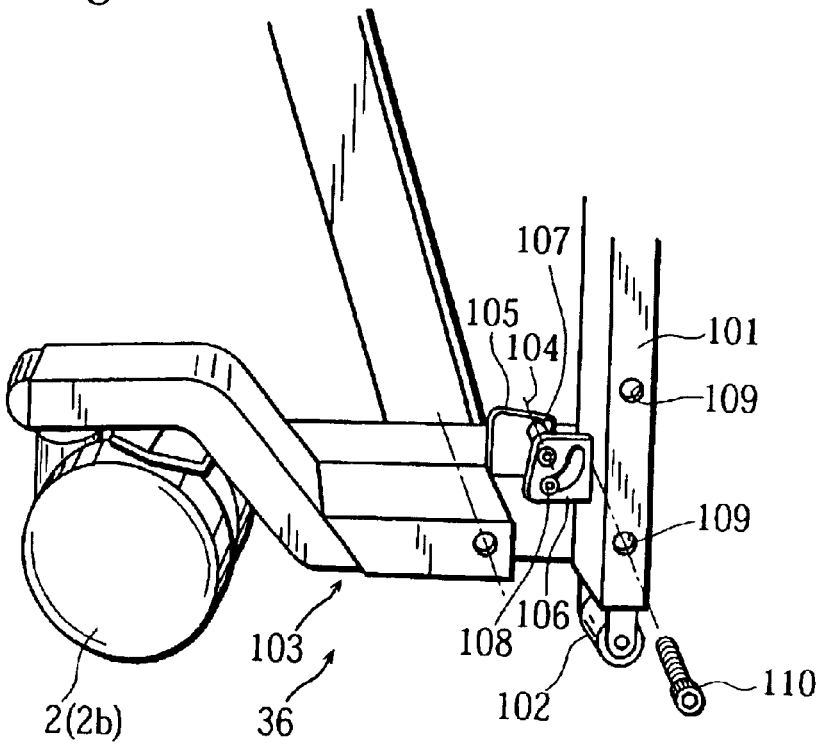
FIG. 23 is a perspective view to explain the leg portion.

And, the oscillation arm portion 101 is attached to the fixation portion 103 as to be freely switched between a forward-protruding used state and an upward-folded stored state at a base end portion side of the oscillation arm portion 101. FIG. 21 is showing the used state, and the oscillation arm portion 101 is folded at the base end portion side in a direction of arrows V to be changed to the stored state. FIG. 22 and FIG. 23 are perspective views to explain the leg portion 36. FIG. 22 shows the used state, and FIG. 23 shows the stored state.

As shown in FIG. 23, an auxiliary wheel 102, disposed on the base end portion of the oscillation arm portion 101, protrudes downward and contacts the ground in the stored state.

To describe concretely, the base end portion of the oscillation arm portion 101 is attached to the fixation portion 103 as to freely oscillate, and 104 is an oscillation center. To describe further, a fixation piece 105 is fixed to the fixation portion 103 and an oscillation piece 106 is fixed to the base end portion of the oscillation arm portion 101 as to face. And, the fixation piece 105 and the oscillation piece 106 are connected with a first connecting shaft 107 and a second connecting shaft 108. The second connecting shaft 108, although fixed to the fixation piece 105, slides along an arc long hole on the oscillation piece 106, and the oscillation arm portion 101 (the oscillation piece 106), of which oscillation angle is restricted to approximately 90°, can oscillate around the first connecting shaft 107 as a center.

As shown in FIG. 22, in the used state, the oscillation arm portion 101 is held approximately horizontal by insertion of fixation bolts 110 to two fixation holes on a side face of the fixation portion 103 (not shown in FIG. 22) and two fixation holes 109 on a side face of the oscillation arm portion 101. And, as shown in FIG. 23, in the stored state, the oscillation arm portion 101 is held approximately vertical (folded state) by insertion of the fixation bolt 110 to one of the fixation holes 109 on the rear side of the oscillation arm portion 101 in the used state and one of the fixation holes on the side face of the fixation portion 103 on the front side.

And, the auxiliary wheel 102 is attached to a base end face of the base end portion of the oscillation arm portion 101. Therefore, the auxiliary wheel 102 is oscillated to protrude downward toward the ground by the above-described folding movement. The chair can move (run) with 4 wheels, namely, the auxiliary wheels 102 and the two rear wheels 2*b*.

Further, as shown in FIG. 21, the seat 4 is freely switched between a horizontal used state and an upright stored state. And, an armrest 20 is disposed on both sides above the seat 4 as to be switched from a horizontal used state to an upright stored state.

Therefore, when the oscillation arm portion 101, the seat 4, and the armrests 20 are folded upward, the elevation chair becomes compact without protrusion to be stored in small space, handled easily in transfer. And, it is preferable that the auxiliary wheel 102 can freely change its rolling direction.

In FIG. 21, safety belt 111 is disposed on the back portion 10 to keep safety as a person does not fall from the chair accidentally when the seat 4, on which the person is sitting, is elevated and the elevation chair is moved with the person.

According to the elevation chair of the present invention, the seat main body 7 is elevated horizontally to a desired height, automatically inclined forward, and certainly stopped to incline when reaches the predetermined inclination angle θ. User's standing movement from the seat 4 and sitting movement on the seat 4 are safely and certainly supported. And, the predetermined inclination angle θ, not influenced by elevation height of the seat 4, can be controlled constant, and constant inclination angle θ can be set as to correspond to various heights of users.

The seat main body 7, being kept horizontal, can be elevated to a desired height to enlarge the application range.

The set height of the seat main body 7, at which the seat main body 7 kept horizontal and elevated to a desired height starts automatic forward inclination, is easily changed, and the height is properly adjusted to various heights of the users.

And, the seat main body 7 is certainly stopped to incline when reaches the predetermined inclination angle θ. Malfunction and instability of movement are eliminated because the detection of the angle is conducted without contact. The predetermined inclination angle θ can be controlled constant without influence by the elevation height of the seat main body 7, and excessive inclination and insufficient inclination of the seat main body 7 are prevented thereby. And, the inclination angle θ is freely changed.

Further, maintenance is easily conducted because it is not required to remove many components for maintenance, regulation, and repair. When the chair is broken, only the driving mechanism M is sent to the maker's workshop for check up and repair without transfer and repair of the whole large and heavy chair.

And, according to the elevation chair of the present invention, the seat main body 7 is elevated horizontally to a desired height, and automatically inclined forward. User's standing movement from the seat 4 and sitting movement on the seat 4 are safely and certainly supported. And, working stroke of the expansion actuator 61 is a half of necessary elevation stroke of the seat 4 because the running rotation pulley 62 has a function as a running pulley, and the apparatus is made compact and light-weight to be easily handled.

Mechanical noise in elevation of the seat 4 is decreased for comfortable use.

In an emergency in which the inner belt 67 suspending the sliding member 28 (the seat 4) is cut by excessive load generated by malfunction of the expansion actuator 61 or degradation of the belt, the person sitting on the seat 4 is not injured by falling of the sliding member 28 (the seat 4).

For an emergency in which the inner belt 67 is cut and the sliding member 28 (the seat 4) is suspended only by the outer belt 66, a safety device with simple construction is made to certainly stop the working of the expansion actuator 61 to prevent the outer belt 66 from cutting by overload generated by the continuously working expansion actuator 61.

The hook 77 with a deflection shaft, of which position is freely changed, can be raised always in constant direction by the suspension belt 78, and safe without parting off the hitching protruding portion 80. And, the hook 77 with a deflection shaft, mainly receiving tensile force and not receiving strong bending force, is safe and its components can be simplified.

The wheel 2 is prevented from being unbraked because it is difficult to have a seat for the footrest 3 occupying footspace when not raised vertically. And, the user is prevented from falling because the chair is restricted as not to spontaneously move backward when the user sits on and gets off the seat 4

And, the wheel 2 is prevented from being unbraked because it is difficult to have a seat for the footrest 3 occupying footspace when not raised vertically. And, the brake is automatically works simultaneously on both of front side and rear side in proceeding direction, and the chair is made safer when the user sits on and gets off the seat 4. And, the brake is released when the footrest 3 is horizontal, and the user can put the feet on the footrest 3 for safety.

And, according to the elevation chair of the present invention, the chair can be stored in small space when the chair is not in use. Further, the chair is easily moved even in the stored state with the auxiliary wheels 102 and the wheel 2 on the rear side.

And, the elevation chair is compact without protrusions and stored in smaller space, and handled easily in transfer.

Further, the brake is made certain with a small number of parts. And, a safe brake excellent in operation can be composed as that the rotation of the wheels 92 is completely restricted, and the elevation chair does not move spontaneously when the user gets on and off the seat 4.

While preferred embodiments of the present invention have been described in this specification, it is to be understood that the invention is illustrative and not restrictive, because various changes are possible within the spirit and indispensable features.

What is claimed is:

1. An elevation chair having a seat ascended and descended by a driving mechanism, comprising a seat main body to which the seat is attached to a seat frame and a forth end portion of the seat frame as to incline forward, an oscillation mechanism which inclines the seat main body automatically at a predetermined height, and an angle detecting means which stops the driving mechanism when the seat main body reaches a predetermined inclination angle, wherein the driving mechanism is provided with a motor, a reducer portion, a guide rail portion, a rotating male screw portion, a sliding female screw portion, and a sliding member, and united as a unit.

2. The elevation chair as set forth in claim 1, wherein the oscillation mechanism has an adjustment mechanism which changes the height at which the forward inclination begins.

3. An elevation chair having a seat ascended and descended by a driving mechanism, comprising a seat main body to which the seat is attached to a seat frame and a forth end portion of the seat frame as to incline forward, an oscillation mechanism which inclines the seat main body automatically at a predetermined height, and an angle detecting means which stops the driving mechanism when the seat main body reaches a predetermined inclination angle, wherein wheels are disposed on a front side and a rear side, and an automatic braking mechanism, in which a brake for the wheel on the front side is released when a footrest attached on a position above the wheel is laid horizontal and the wheel is braked when the footrest is raised upright, is provided, wherein:

the automatic braking mechanism has a front braking arm having a footrest receiving portion protruding from a top plate of a wheel bracket on one end and a brake pad sliding on front side of the wheel on another end, and a rear braking arm having footrest receiving portion protruding from the top plate of the wheel bracket on one end and a brake pad sliding on rear side of the wheel on another end, and a reverse face of the footrest pushes the footrest receiving portions as the brake pads are parted from the wheel when the footrest is laid horizontal.

4. An elevation chair having a seat ascended and descended by a driving mechanism, comprising a seat main body to which the seat is attached to a seat frame and a forth end portion of the seat frame as to incline forward, an oscillation mechanism which inclines the seat main body automatically at a predetermined height, and an angle detecting means which stops the driving mechanism when the seat main body reaches a predetermined inclination angle, wherein the chair has a pedal braking mechanism in which:

an end portion of a brake pedal is attached as to oscillate around a first horizontal axis, an operation pedal portion is disposed on another end portion, a middle portion of a leg portion of a brake shaft of rod approximately U-shaped is attached as to oscillate around a second horizontal axis, an end portion of the leg portion of the brake shaft contacts a wheel by the oscillation to brake the wheel; and a back portion of the brake shaft is connected to the brake pedal on a position on the operation pedal portion side to the first horizontal axis and out of a straight line going through the first horizontal axis and the second horizontal axis, and the back portion of the brake shaft is pulled as to oscillate around the second horizontal axis with elastic deformation by oscillation of the operation pedal portion of the brake pedal around the first horizontal axis to brake and release the wheel.

* * * * *